US007290468B1

(12) United States Patent
Cheng

(10) Patent No.: US 7,290,468 B1
(45) Date of Patent: Nov. 6, 2007

(54) SOCKET ADAPTER HAVING POSITIONING EFFECT

(76) Inventor: Chin Shun Cheng, No. 22, Lane 427, Dasheng Street, Taichung City 408 (TW)

( * ) Notice: Subject to any disclaimer, the term of this patent is extended or adjusted under 35 U.S.C. 154(b) by 14 days.

(21) Appl. No.: 11/040,792

(22) Filed: Jan. 24, 2005

(51) Int. Cl.
*B25B 23/16* (2006.01)
*B25G 1/00* (2006.01)
*B25B 13/00* (2006.01)

(52) U.S. Cl. ..... 81/177.2; 81/124.4; 81/121.1

(58) Field of Classification Search ..... 81/177.85, 81/124.4, 125.1, 121.1, 124.6
See application file for complete search history.

(56) References Cited

U.S. PATENT DOCUMENTS 3,306,639 A * 2/1967 Lyon ..... 403/107
6,971,290 B1 * 12/2005 Ybarra ..... 81/177.2
2003/0033912 A1 * 2/2003 Coffland et al. ..... 81/177.85
2004/0173061 A1 * 9/2004 Liou ..... 81/177.85

* cited by examiner

*Primary Examiner*—Alvin J. Grant

(57) ABSTRACT

A socket adapter includes a main body having a receiving recess and a slide slot, a drive rod slidably mounted in the slide slot of the main body, and a control member movably mounted in the main body. Thus, the drive rod has a plurality of locking grooves, and the control member has a locking portion, so that when the control member is moved relative to the drive rod, the locking portion of the control member is locked in or detached from the respective locking groove of the drive rod, thereby positioning the drive rod on the main body or releasing the drive rod from the main body.

1 Claim, 32 Drawing Sheets

SOCKET ADAPTER HAVING POSITIONING EFFECT

BACKGROUND OF THE INVENTION

1. Field of the Invention

The present invention relates to a socket adapter, and more particularly to a socket adapter having a positioning effect.

2. Description of the Related Art

A conventional socket adapter in accordance with the prior art shown in FIGS. 68 and 69 comprises a main body 90 having a peripheral wall formed with a slide slot 901 and having an end formed with a drive head 902 for mounting a socket (not shown), and a drive rod 91 slidably mounted in the slide slot 901 of the main body 90. Thus, when the drive rod 91 is rotated, the main body 90 is rotated to rotate the drive rod 91 so as to rotate the socket. However, the drive rod 91 easily slips in the slide slot 901 of the main body 90 during operation, thereby causing inconvenience to a user when driving the drive rod 91 to rotate the main body 90.

The closest prior art references of which the applicant is aware are disclosed in U.S. Pat. Nos. 1,102,863 and 6,260,452.

SUMMARY OF THE INVENTION

The primary objective of the present invention is to provide a socket adapter having a positioning effect.

Another objective of the present invention is to provide a socket adapter, wherein the drive rod has a plurality of locking grooves, and the control member has a locking portion, so that when the control member is moved relative to the drive rod, the locking portion of the control member is locked in or detached from the respective locking groove of the drive rod, thereby positioning the drive rod on the main body or releasing the drive rod from the main body.

Further benefits and advantages of the present invention will become apparent after a careful reading of the detailed description with appropriate reference to the accompanying drawings.

DETAILED DESCRIPTION OF THE INVENTION

Figure 1:
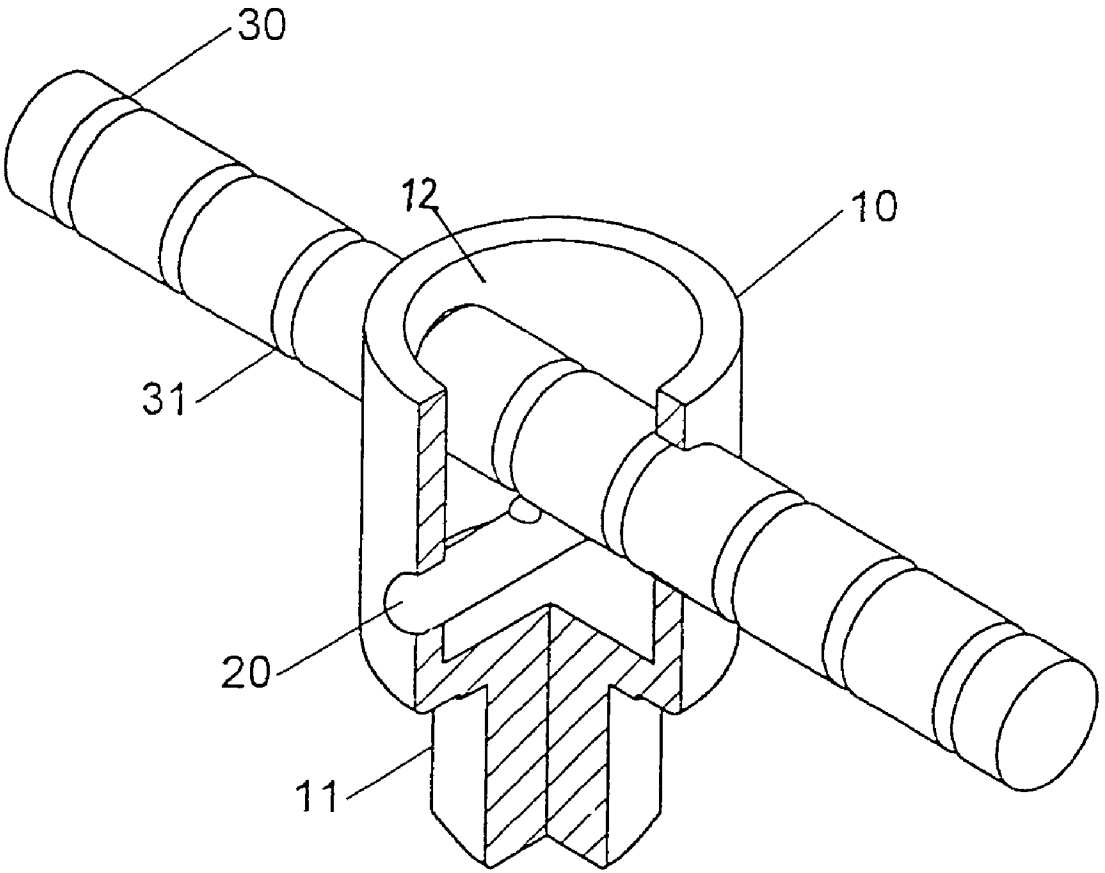
FIG. 1 is a partially perspective cross-sectional view of a socket adapter in accordance with the preferred embodiment of the present invention.
Figure 2:
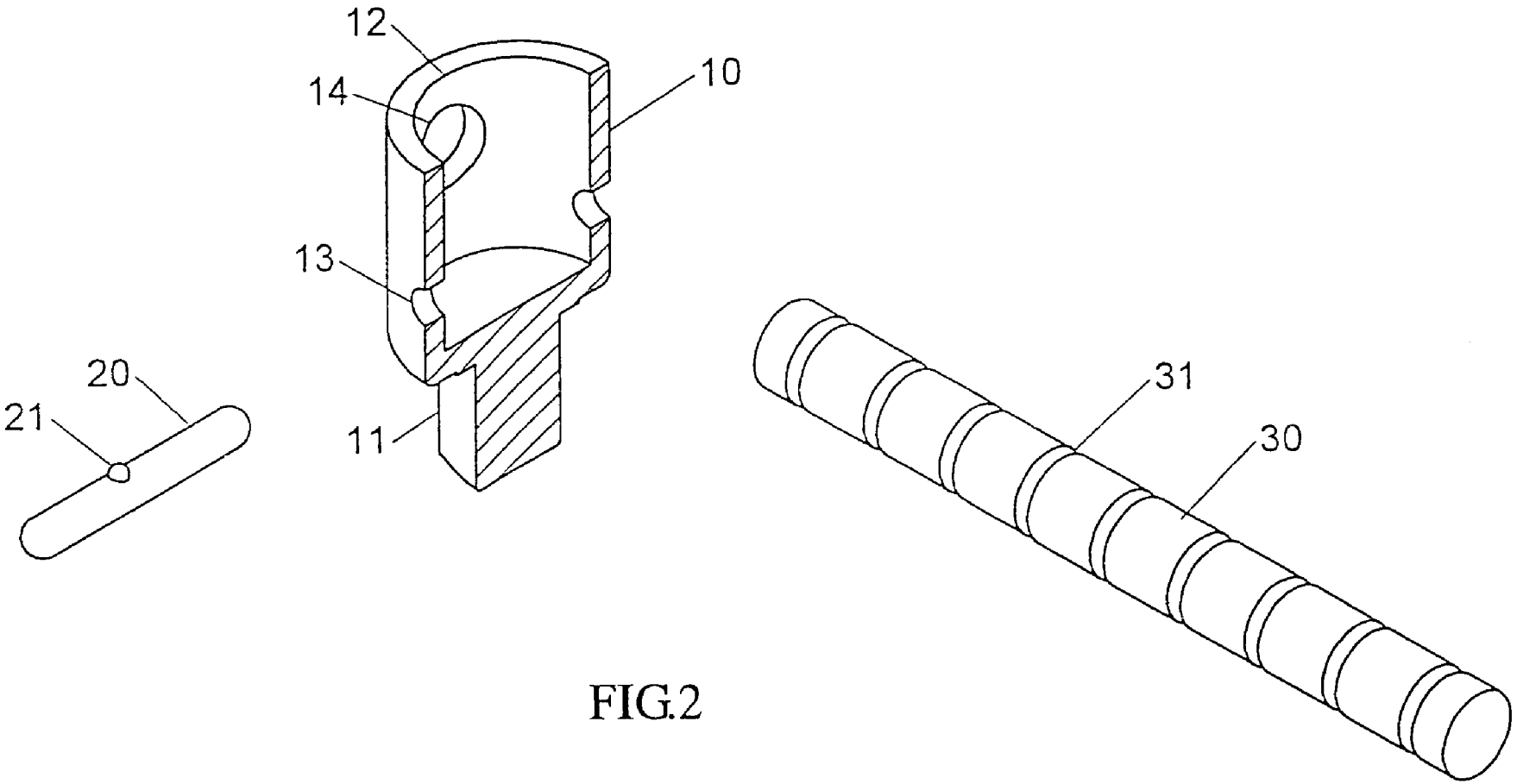
FIG. 2 is a partially exploded perspective cross-sectional view of the socket adapter as shown in FIG. 1.

Referring to the drawings and initially to FIGS. 1-8, a socket adapter in accordance with the preferred embodiment of the present invention comprises a main body 10 having an inside formed with a receiving recess 12 and a peripheral wall formed with a slide slot 14 connected to the receiving recess 12, a drive rod 30 slidably mounted in the slide slot 14 of the main body 10 and formed with a plurality of locking grooves 31, and a control member 20 movably mounted in the main body 10 and provided with a locking portion 21 detachably locked in one of the locking grooves 31 of the drive rod 30.

The main body 10 has an end provided with a drive head 11. The peripheral wall of the main body 10 is formed with a control slot 13 located perpendicular to the slide slot 14, and the control member 20 is movably mounted in the control slot 13 of the main body 10 and has two ends each protruding outward from the control slot 13 of the main body 10.

Figure 7:
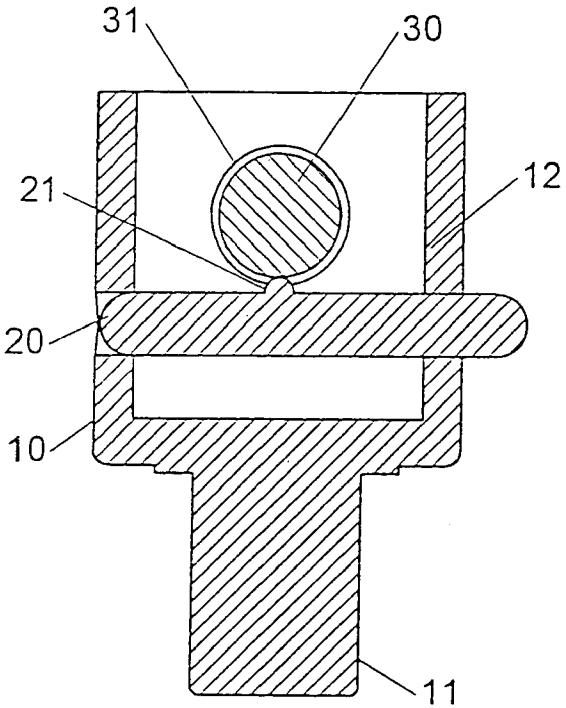
FIG. 7 is a schematic operational view of the socket adapter as shown in FIG. 4.
Figure 6:
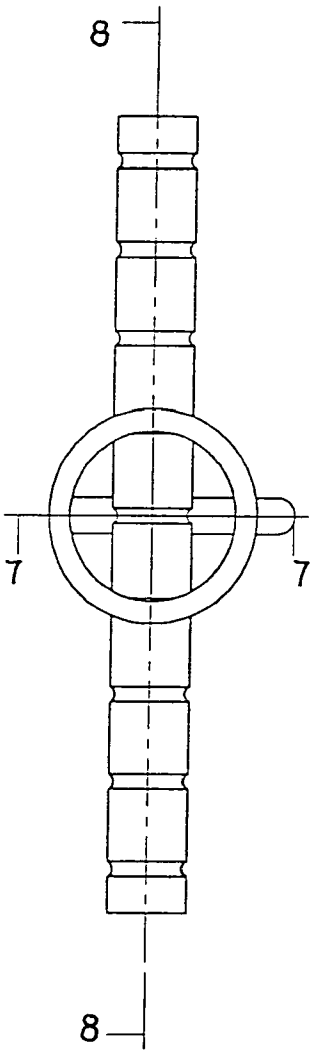
FIG. 6 is a schematic operational view of the socket adapter as shown in FIG. 3.
Figure 8:
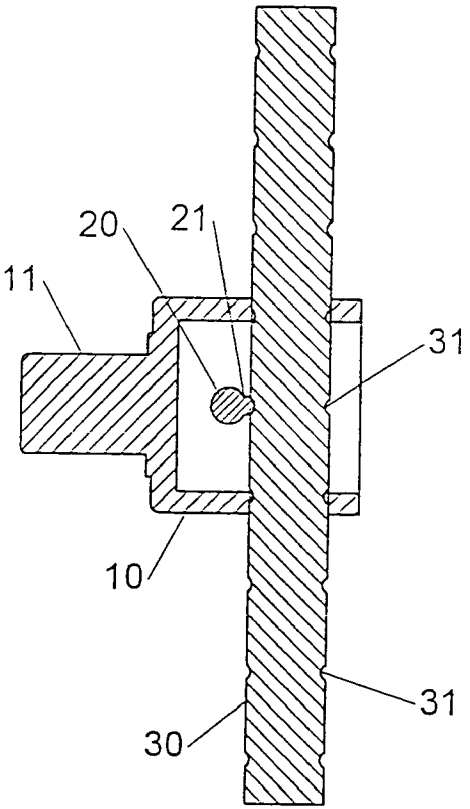
FIG. 8 is a schematic operational view of the socket adapter as shown in FIG. 5.
Figure 9:
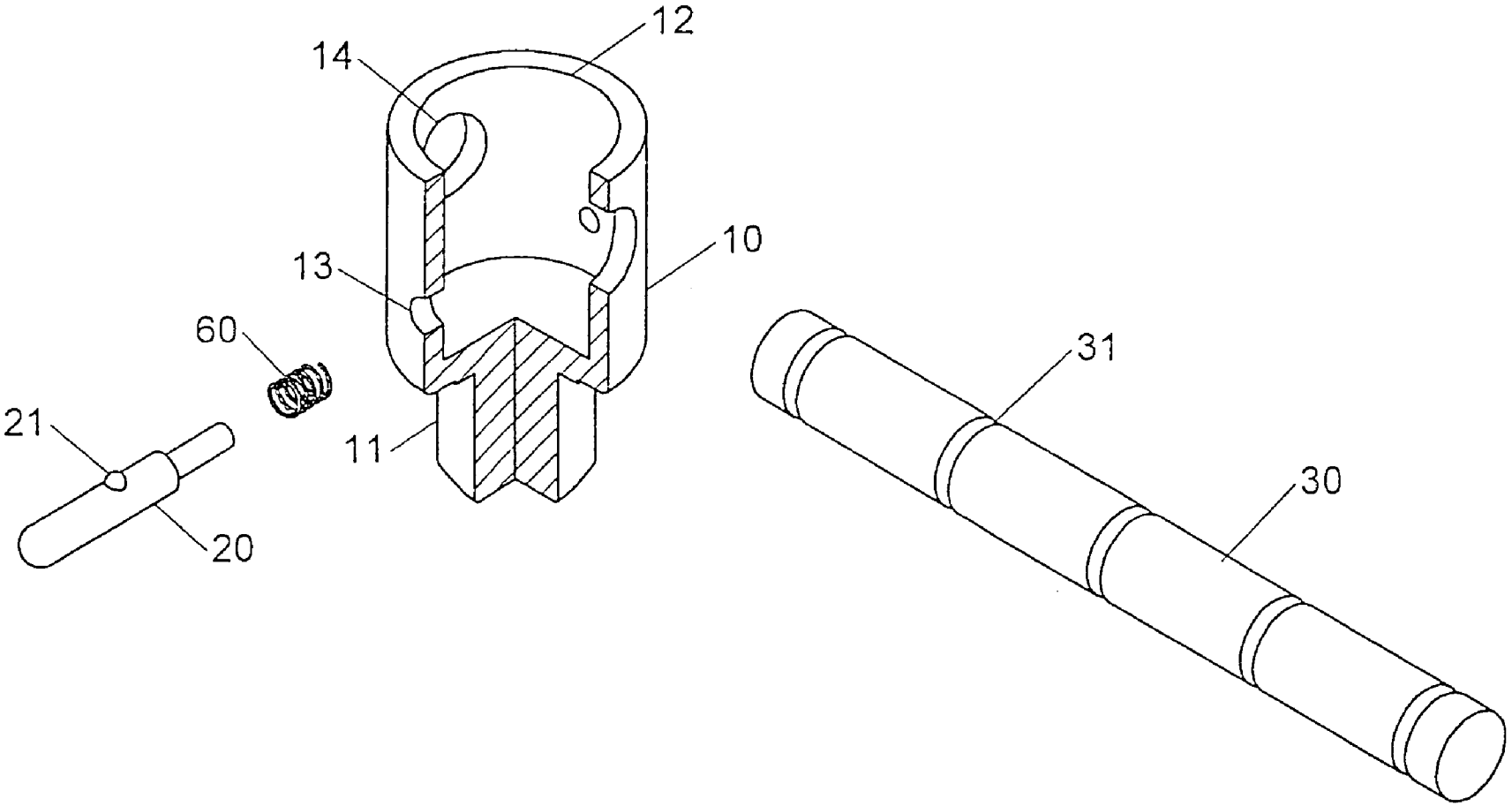
FIG. 9 is a partially exploded perspective cross-sectional view of a socket adapter in accordance with another embodiment of the present invention.

In operation, when the control member 20 is moved to the position as shown in FIGS. 6-8, the locking portion 21 of the control member 20 is locked in one of the locking grooves 31 of the drive rod 30, so that the drive rod 30 is positioned on the main body 10 by the control member 20, thereby facilitating a user driving the drive rod 30 to rotate the main body 10 which drives the drive head 11 to rotate a socket (not shown).

Figure 4:
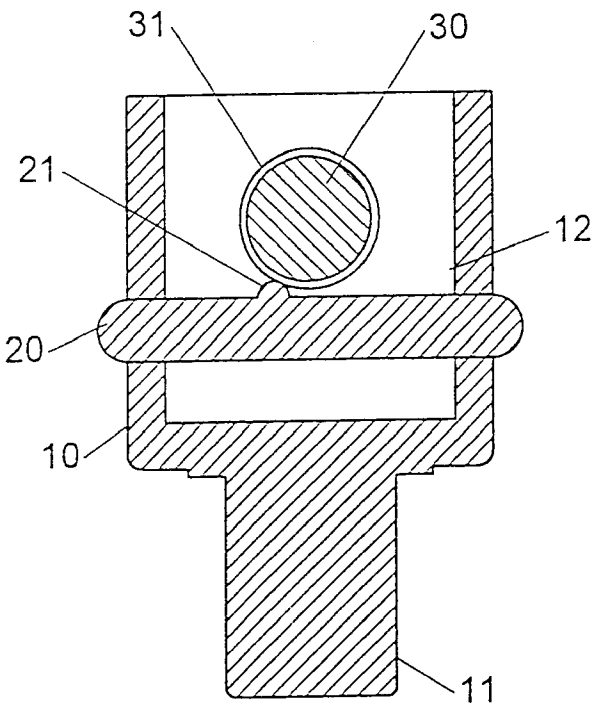
FIG. 4 is a plan cross-sectional view of the socket adapter taken along line 4-4 as shown in FIG. 3.
Figure 3:
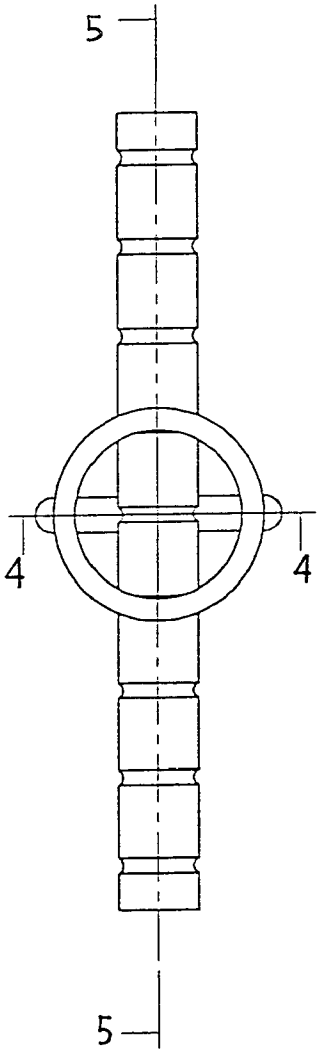
FIG. 3 is a plan view of the socket adapter as shown in FIG. 1.
Figure 5:
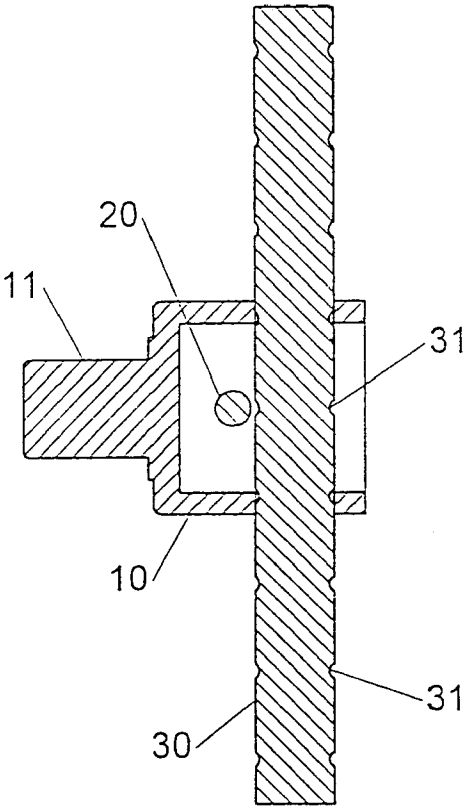
FIG. 5 is a plan cross-sectional view of the socket adapter taken along line 5-5 as shown in FIG. 3.

Alternatively, when the control member 20 is moved to the position as shown in FIGS. 3-5, the locking portion 21 of the control member 20 is detached from one of the locking grooves 31 of the drive rod 30, so that the drive rod 30 is freely slidable on the main body 10 so as to adjust the position of the drive rod 30 relative to the main body 10.

Figure 11:
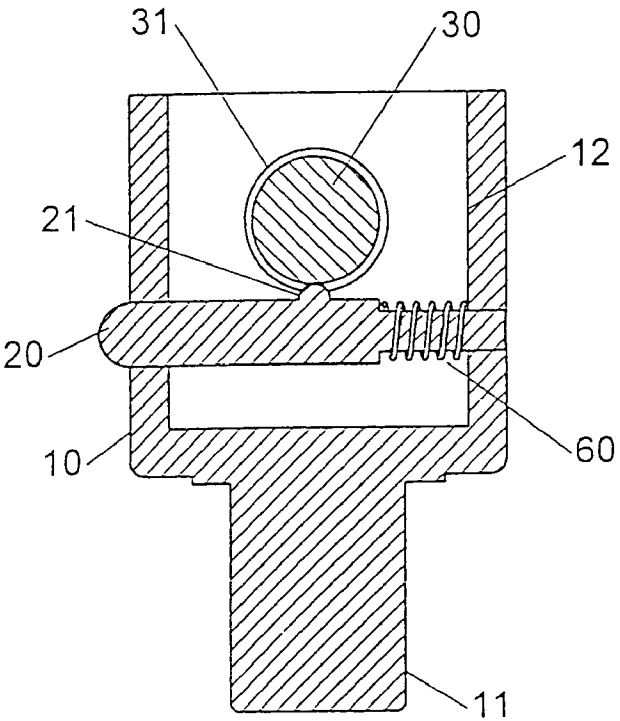
FIG. 11 is a plan cross-sectional view of the socket adapter taken along line 11-11 as shown in FIG. 10.
Figure 10:
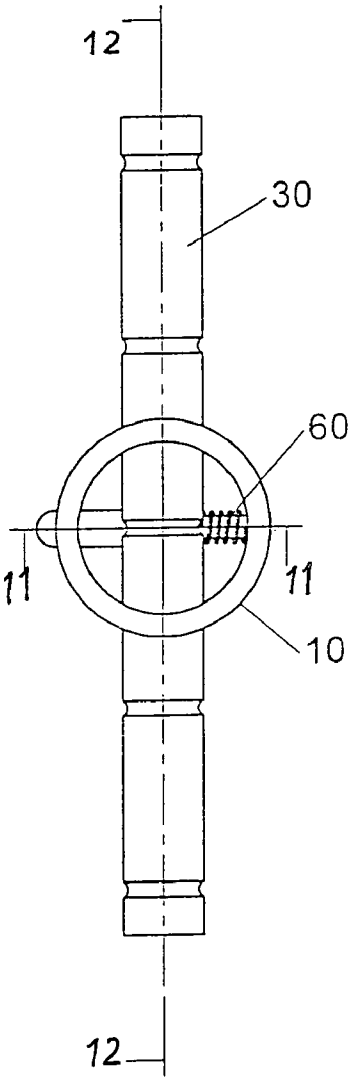
FIG. 10 is a plan assembly view of the socket adapter as shown in FIG. 9.
Figure 12:
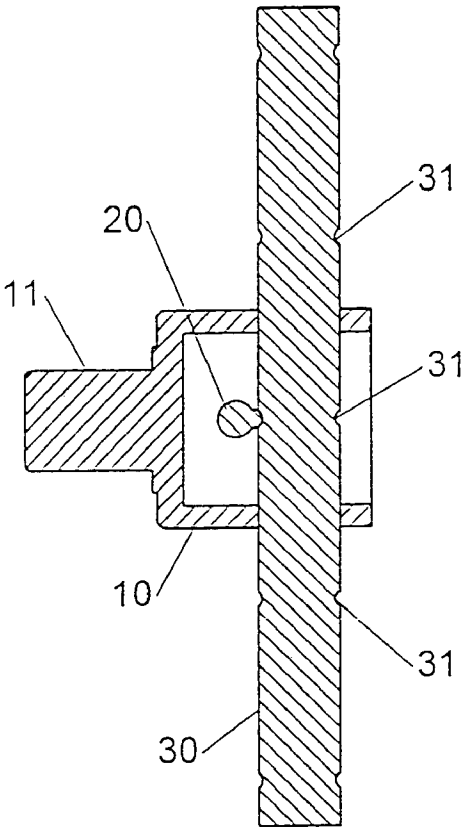
FIG. 12 is a plan cross-sectional view of the socket adapter taken along line 12-12 as shown in FIG. 10.
Figure 13:
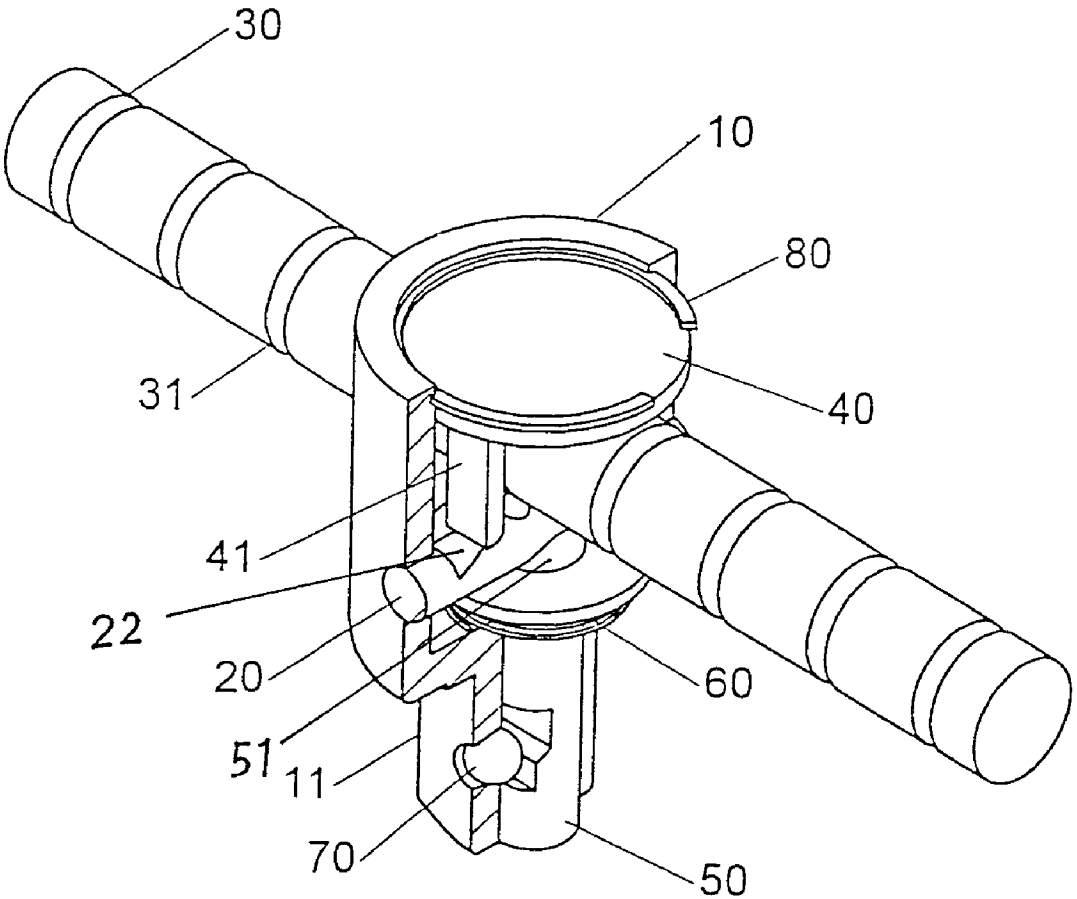
FIG. 13 is a partially perspective cross-sectional view of a socket adapter in accordance with another embodiment of the present invention.
Figure 14:
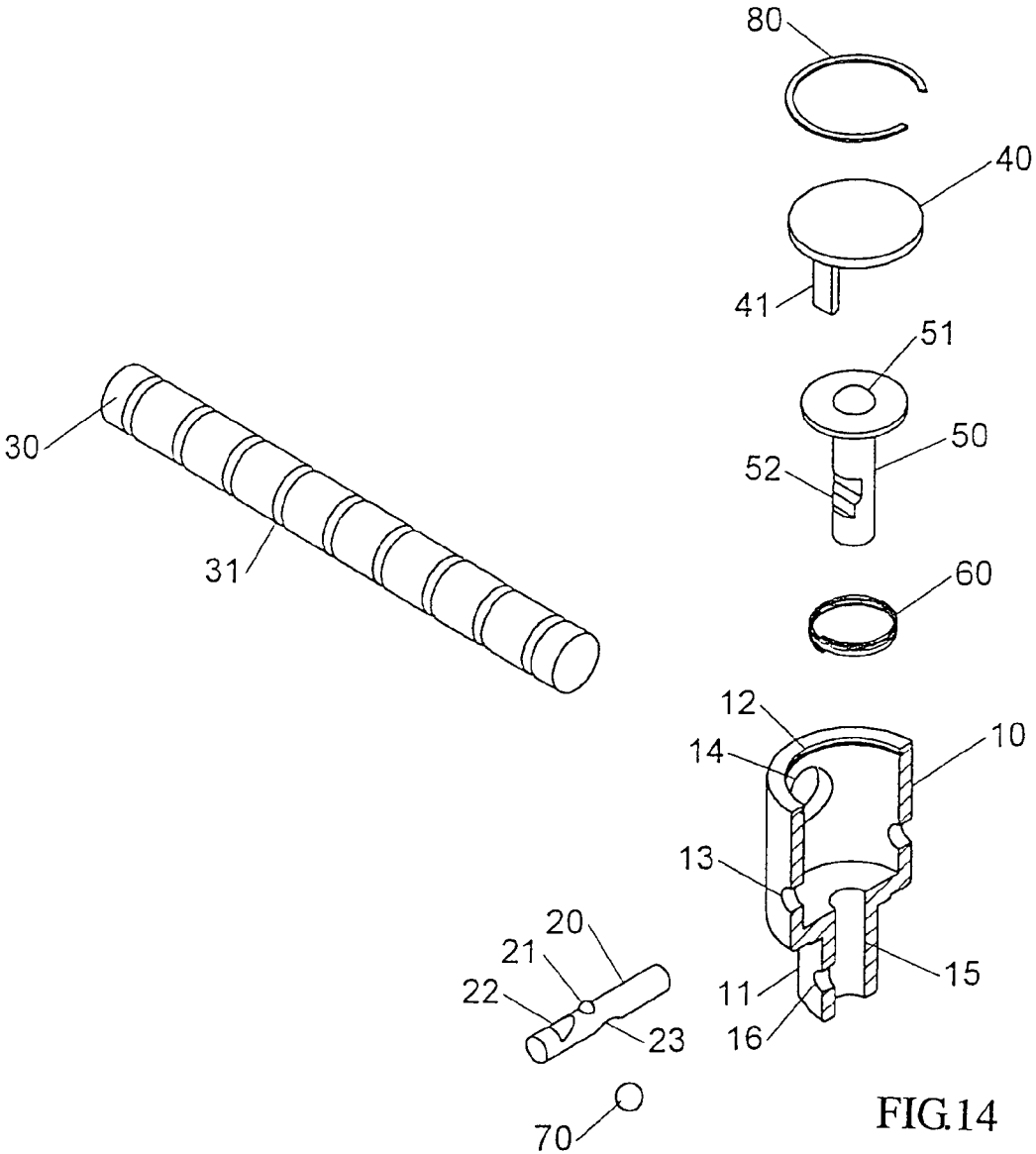
FIG. 14 is a partially exploded perspective cross-sectional view of the socket adapter as shown in FIG. 13.

Referring to FIGS. 9-12, a socket adapter in accordance with another embodiment of the present invention further comprises an elastic member 60 mounted on the control member 20 and having a first end pressed on a wall of the receiving recess 12 of the main body 10 and a second end pressed on an end of the control member 20. The control member 20 is pressed by the elastic force of the elastic member 60, so that the locking portion 21 of the control member 20 is locked in one of the locking grooves 31 of the drive rod 30 as shown in FIG. 11, and the drive rod 30 is positioned on the main body 10 by the control member 20. When the control member 20 is pressed inward, the locking portion 21 of the control member 20 is detached from one of the locking grooves 31 of the drive rod 30, so that the drive rod 30 is freely slidable on the main body 10 so as to adjust the position of the drive rod 30 relative to the main body 10.

Referring to FIGS. 13-18, in accordance with another embodiment of the present invention, the drive head 11 of the main body 10 has an inside formed with an operation slot 15 connected to the receiving recess 12 and a peripheral wall formed with a ball hole 16 connected to the operation slot 15 for receiving a ball 70. The control member 20 has a first side formed with an inclined recessed control portion 22 and a second side formed with a recessed resting portion 23.

The socket adapter further comprises an operation rod 50 movably mounted in the operation slot 15 of the drive head 11 and having a first end formed with a stepped face 52 aligning with the ball hole 16 of the drive head 11 and rested on the ball 70 and a second end formed with a protruding block 51 rested on the resting portion 23 of the control member 20, an elastic member 60 mounted on the operation rod 50 and biased between the second end of the operation rod 50 and the receiving recess 12 of the main body 10, a press block 40 movably mounted in the receiving recess 12 of the main body 10 and provided with a press portion 41 rested on the control portion 22 of the control member 20, and a snap ring 80 secured in the receiving recess 12 of the main body 10 and rested on the press block 40 to retain the press block 40 in the receiving recess 12 of the main body 10.

Figure 16:
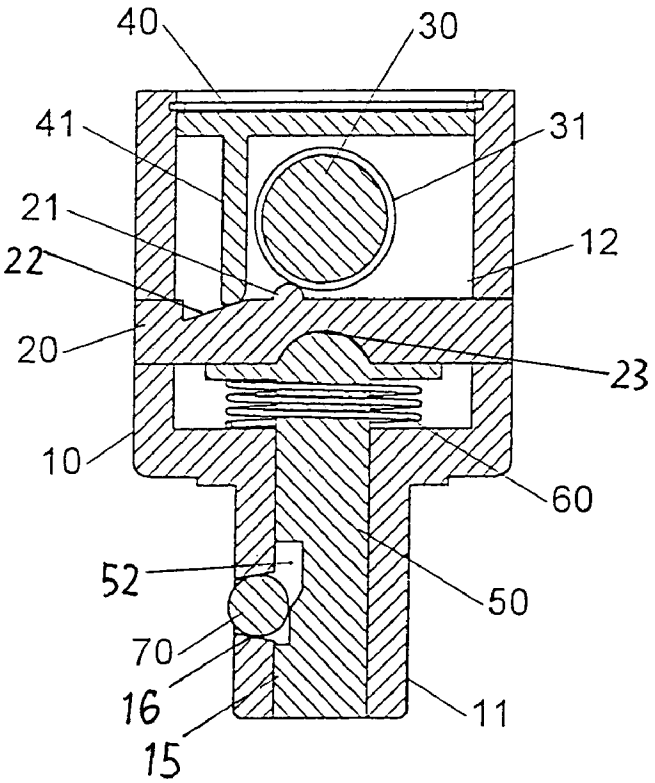
FIG. 16 is a plan cross-sectional view of the socket adapter taken along line 16-16 as shown in FIG. 15.
Figure 15:
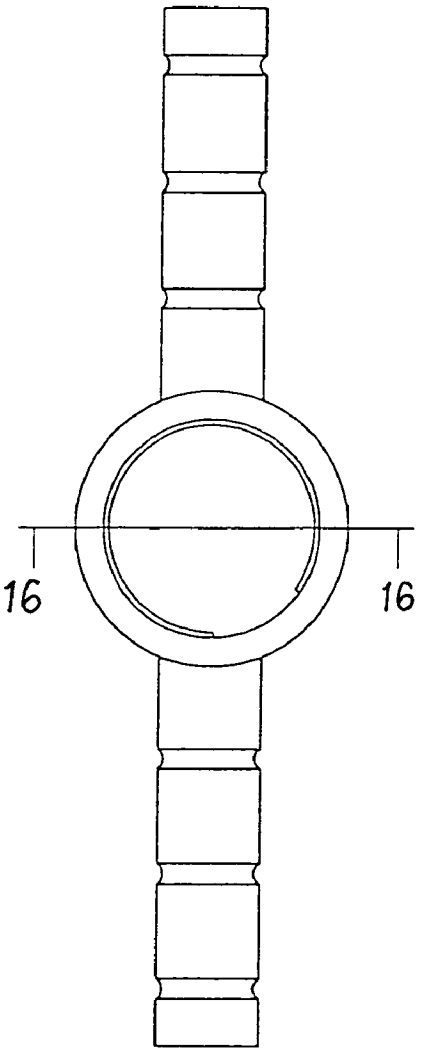
FIG. 15 is a plan view of the socket adapter as shown in FIG. 13.

As shown in FIGS. 15 and 16, the press portion 41 of the press block 40 is rested on a shallower part of the control portion 22 of the control member 20, the protruding block 51 of the operation rod 50 is rested on the resting portion 23 of the control member 20, and the ball 70 is received in a shallower part of the stepped face 52 of the operation rod 50.

Figure 18:
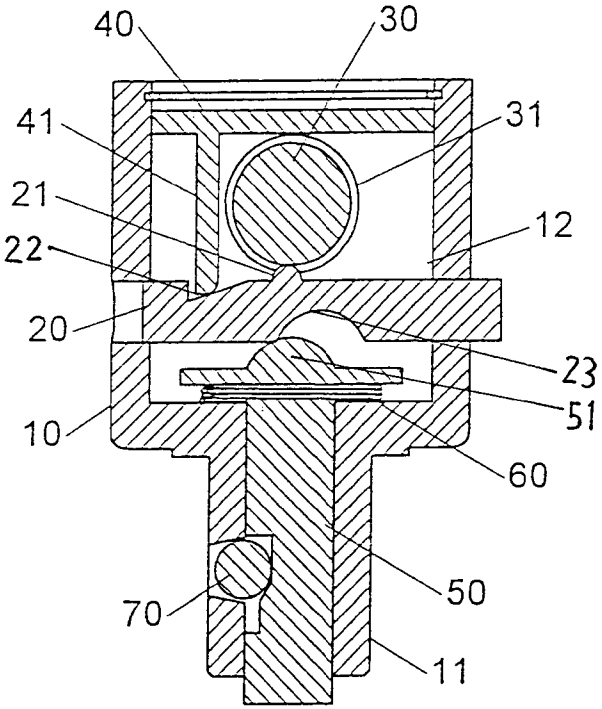
FIG. 18 is a schematic operational view of the socket adapter as shown in FIG. 16.
Figure 17:
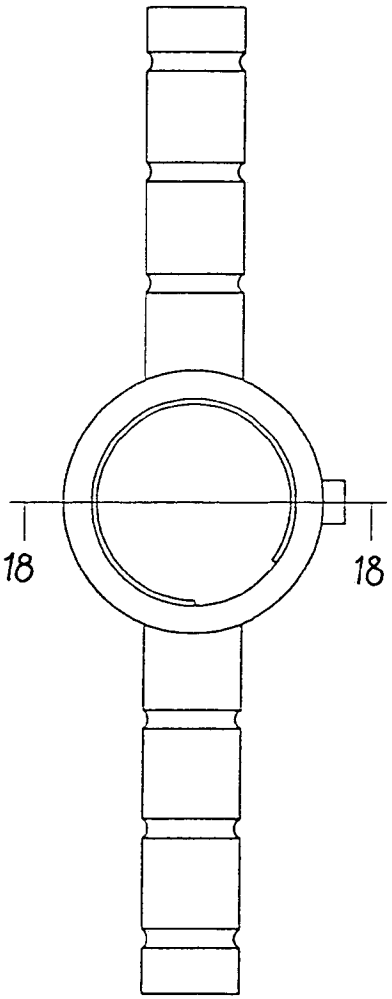
FIG. 17 is a schematic operational view of the socket adapter as shown in FIG. 15.
Figure 19:
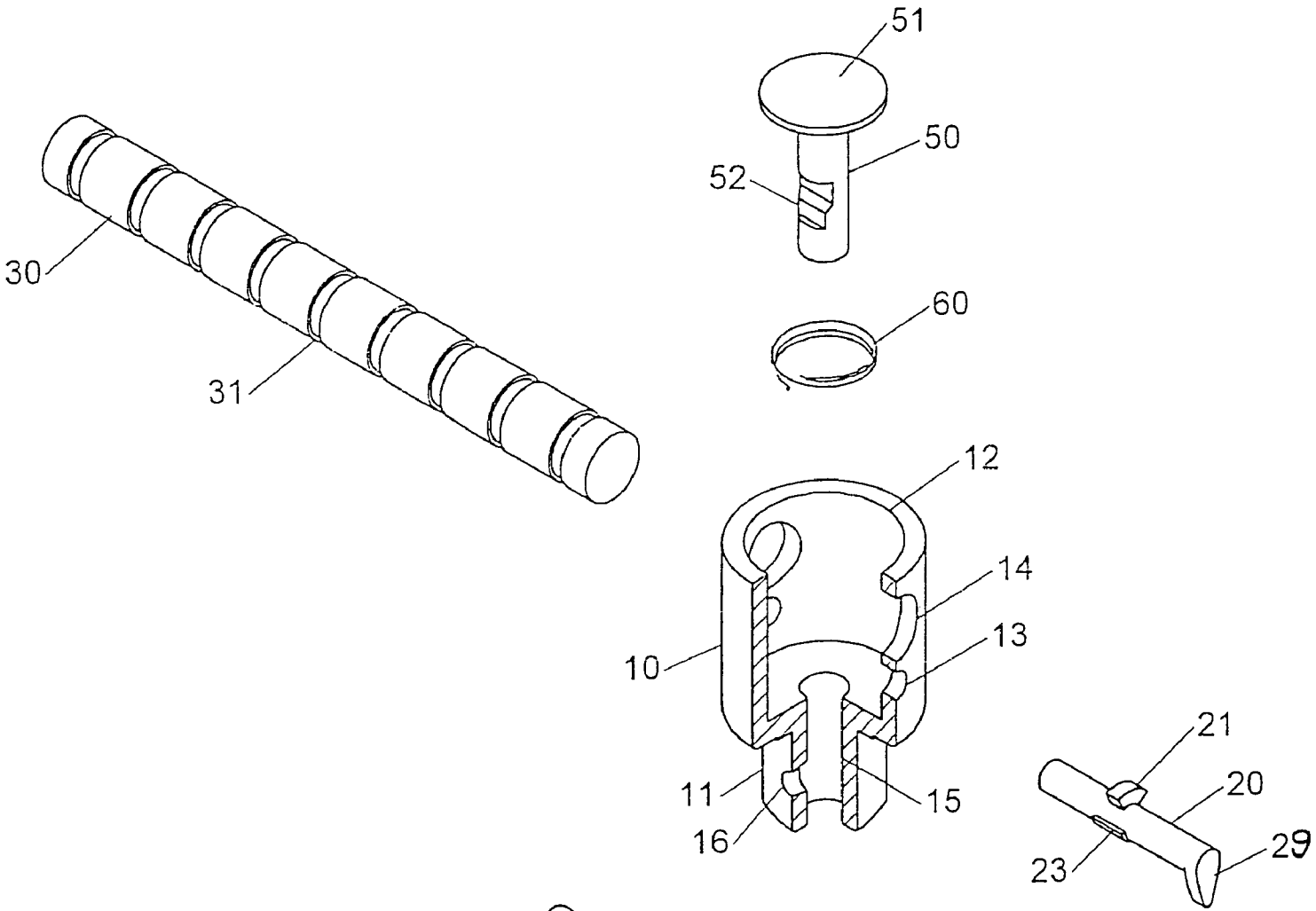
FIG. 19 is a partially exploded perspective cross-sectional view of a socket adapter in accordance with another embodiment of the present invention.
Figure 21:
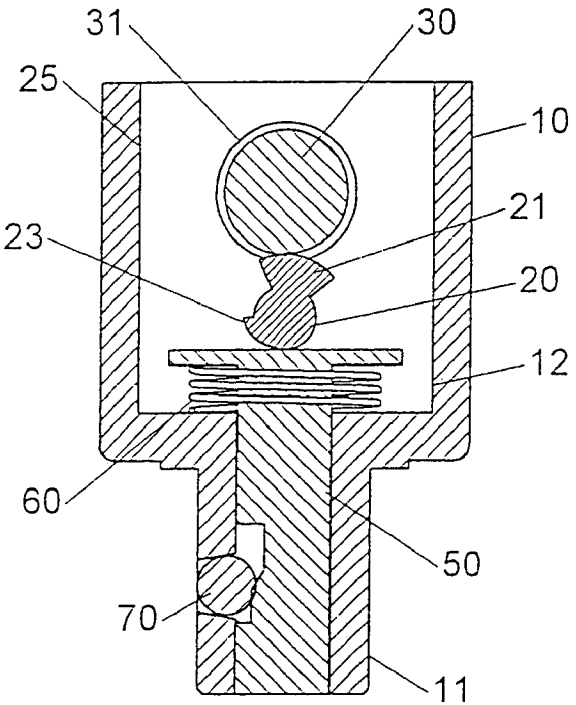
FIG. 21 is a plan cross-sectional view of the socket adapter taken along line 21-21 as shown in FIG. 20.
Figure 20:
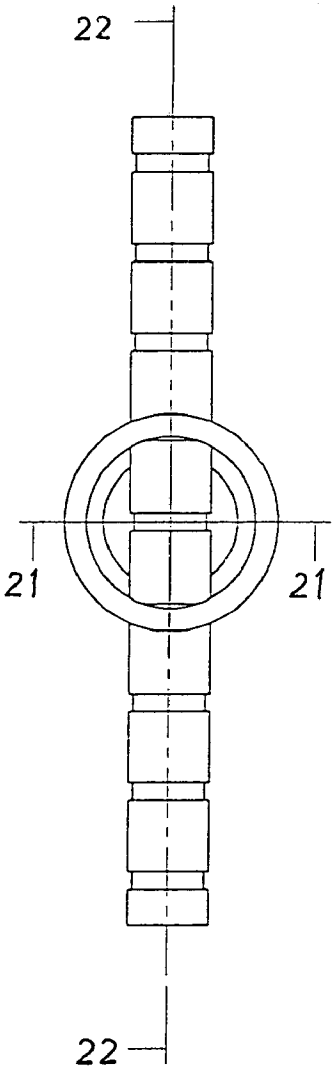
FIG. 20 is a plan assembly view of the socket adapter as shown in FIG. 19.
Figure 22:
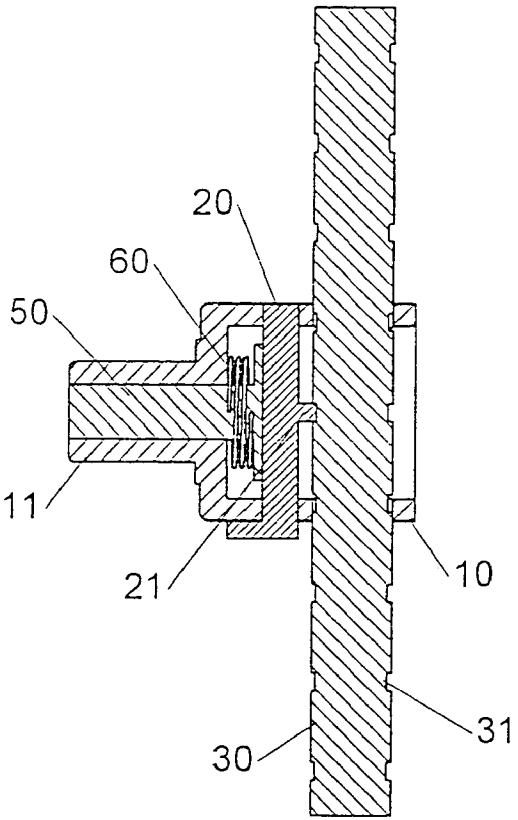
FIG. 22 is a plan cross-sectional view of the socket adapter taken along line 22-22 as shown in FIG. 20.
Figure 24:
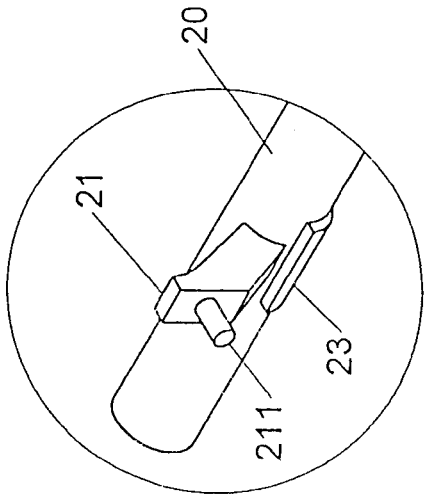
FIG. 24 is a locally enlarged view of the socket adapter as shown in FIG. 23.
Figure 23:
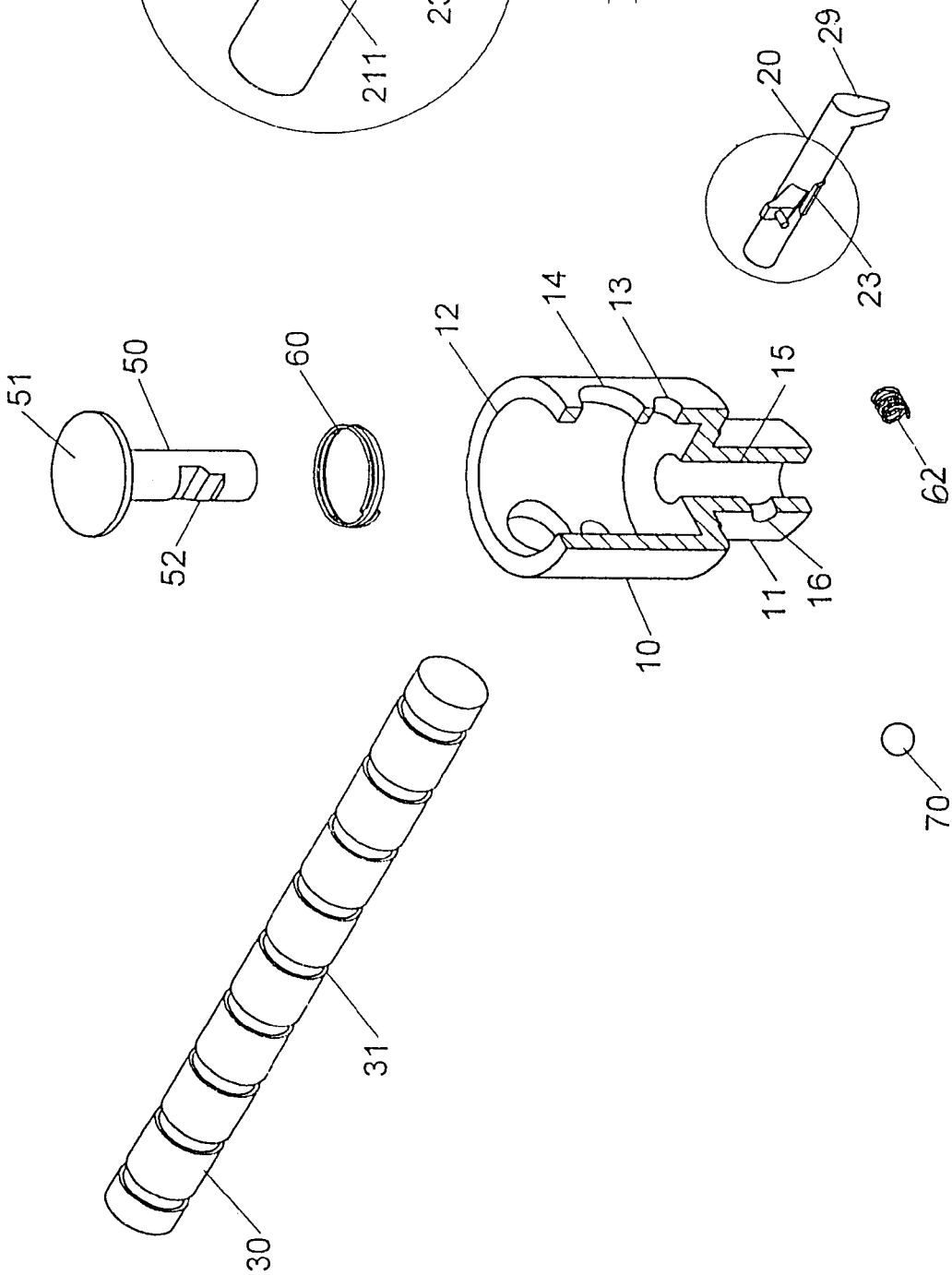
FIG. 23 is a partially exploded perspective cross-sectional view of a socket adapter in accordance with another embodiment of the present invention.
Figure 26:
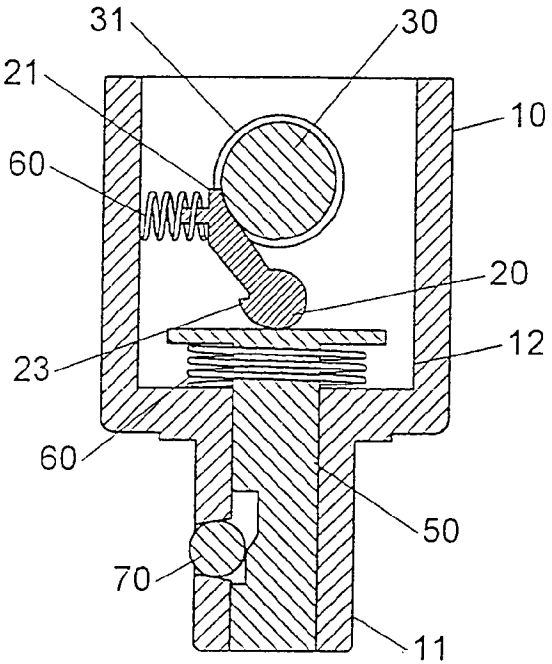
FIG. 26 is a plan cross-sectional view of the socket adapter taken along line 26-26 as shown in FIG. 25.
Figure 25:
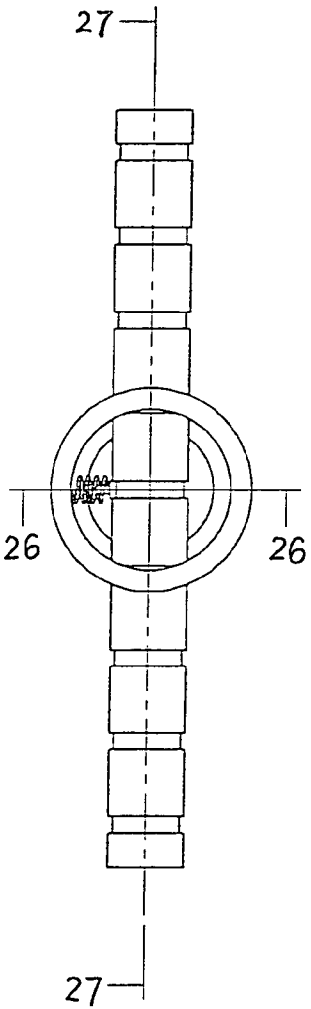
FIG. 25 is a plan assembly view of the socket adapter as shown in FIG. 23.
Figure 27:
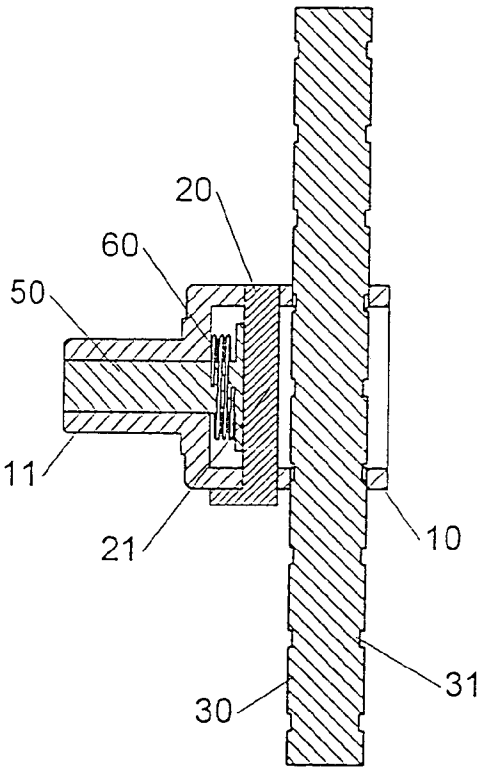
FIG. 27 is a plan cross-sectional view of the socket adapter taken along line 27-27 as shown in FIG. 25.
Figure 29:
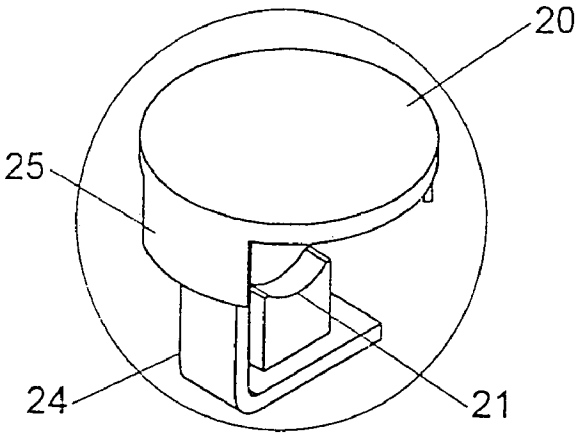
FIG. 29 is a locally enlarged view of the socket adapter as shown in FIG. 28.
Figure 28:
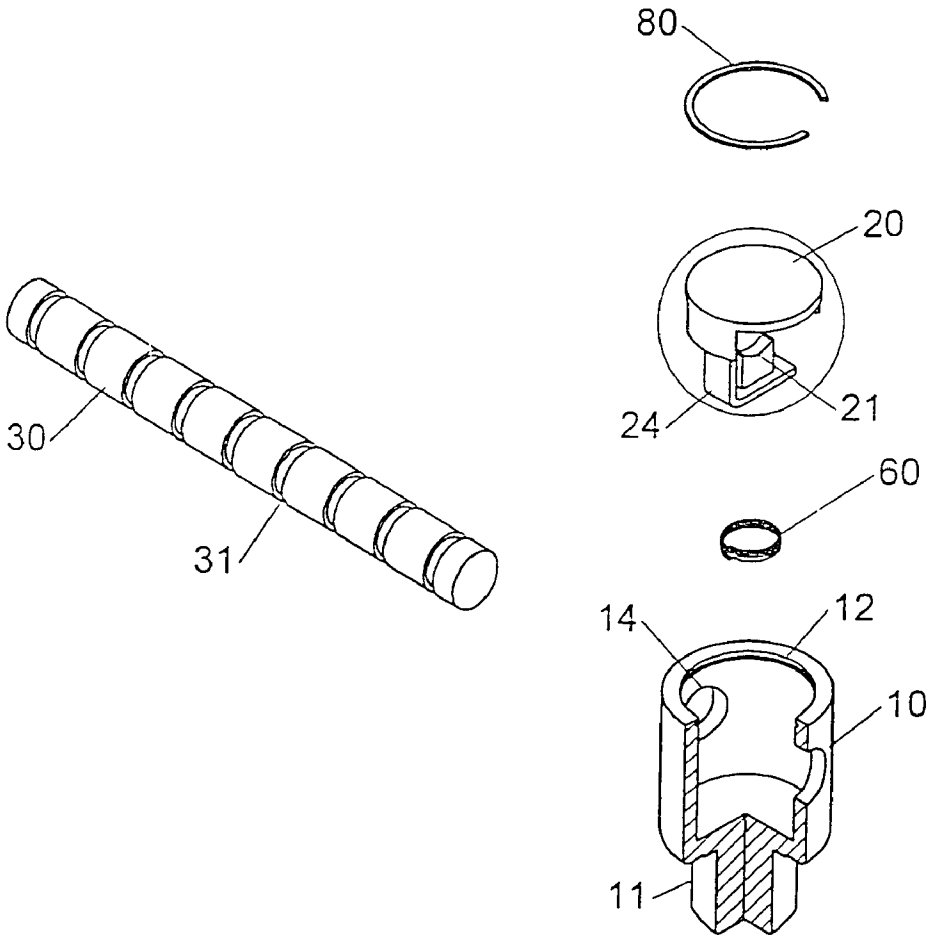
FIG. 28 is a partially exploded perspective cross-sectional view of a socket adapter in accordance with another embodiment of the present invention.
Figure 31:
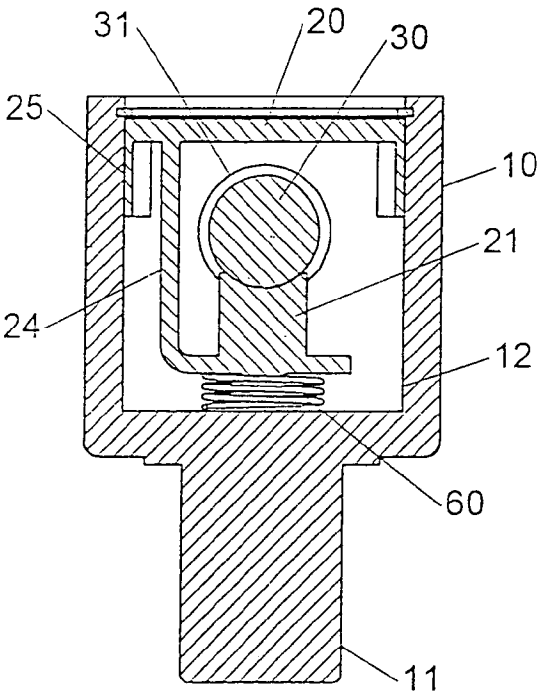
FIG. 31 is a plan cross-sectional view of the socket adapter taken along line 31-31 as shown in FIG. 30.
Figure 30:
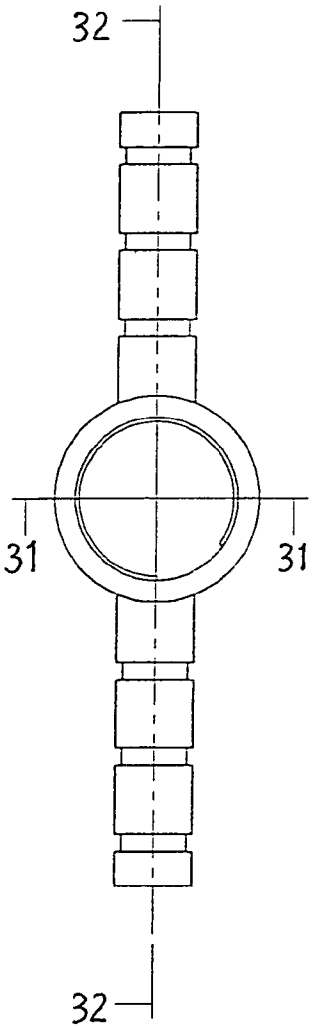
FIG. 30 is a plan assembly view of the socket adapter as shown in FIG. 28.
Figure 32:
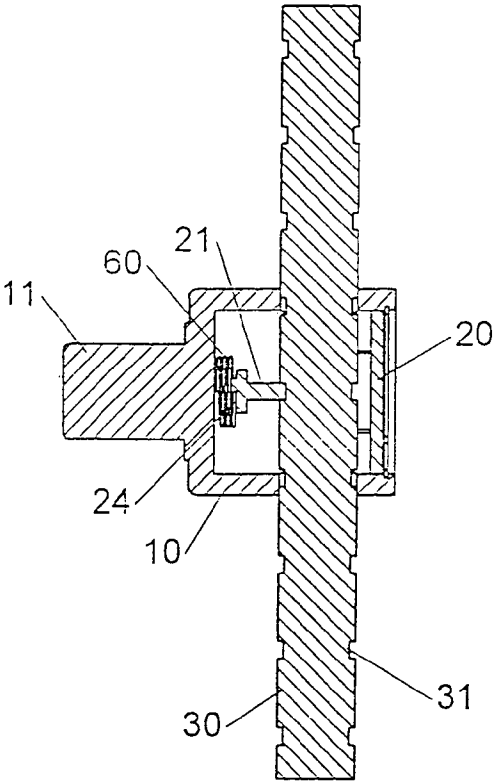
FIG. 32 is a plan cross-sectional view of the socket adapter taken along line 32-32 as shown in FIG. 30.
Figure 34:
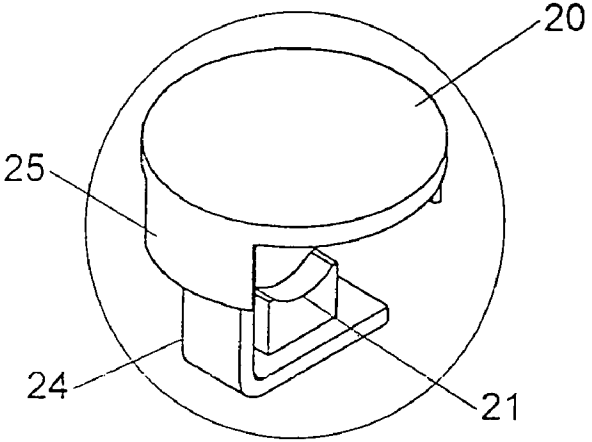
FIG. 34 is a locally enlarged view of the socket adapter as shown in FIG. 33.
Figure 33:
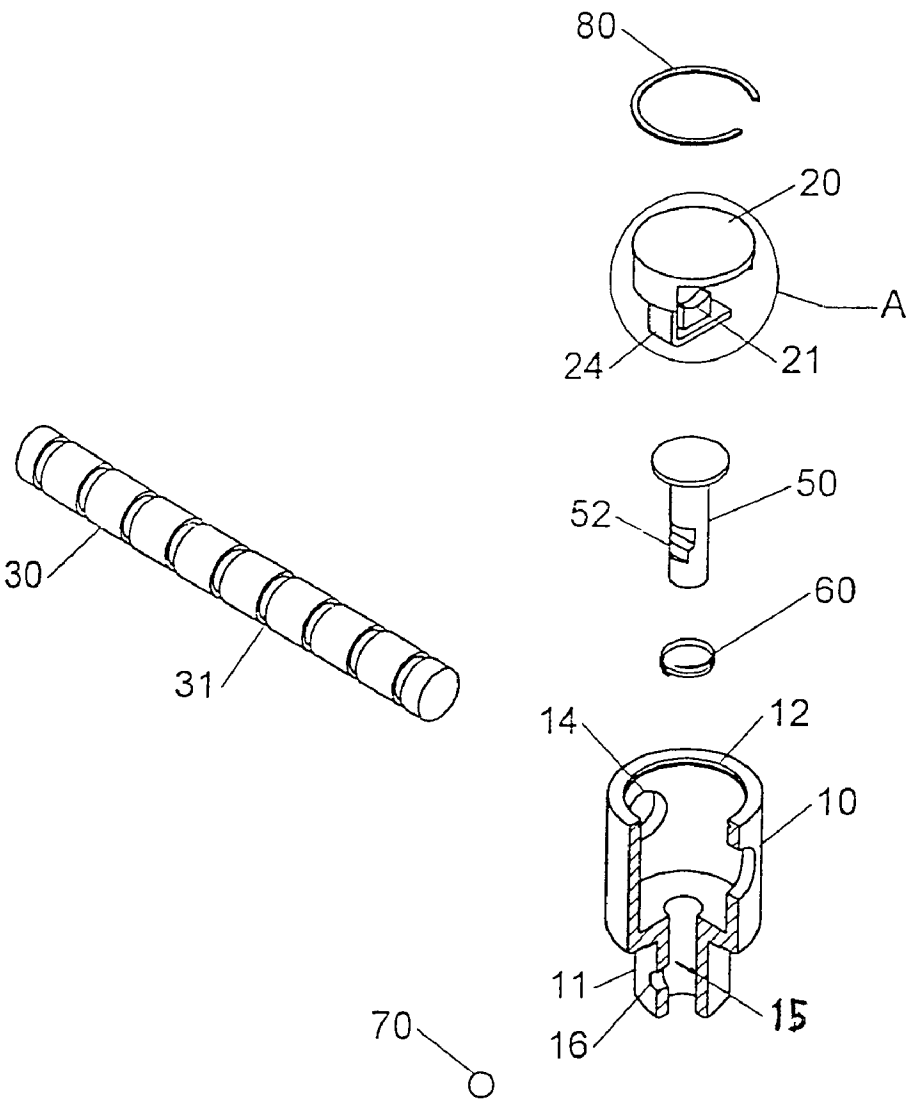
FIG. 33 is a partially exploded perspective cross-sectional view of a socket adapter in accordance with another embodiment of the present invention.
Figure 36:
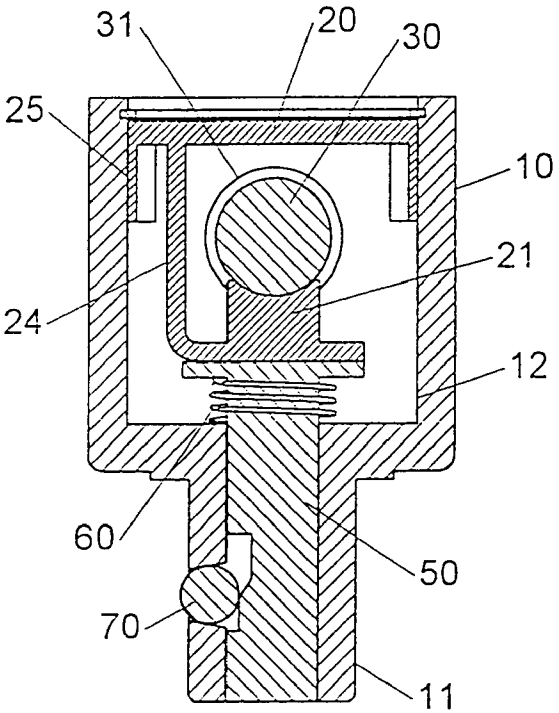
FIG. 36 is a plan cross-sectional view of the socket adapter taken along line 36-36 as shown in FIG. 35.
Figure 35:
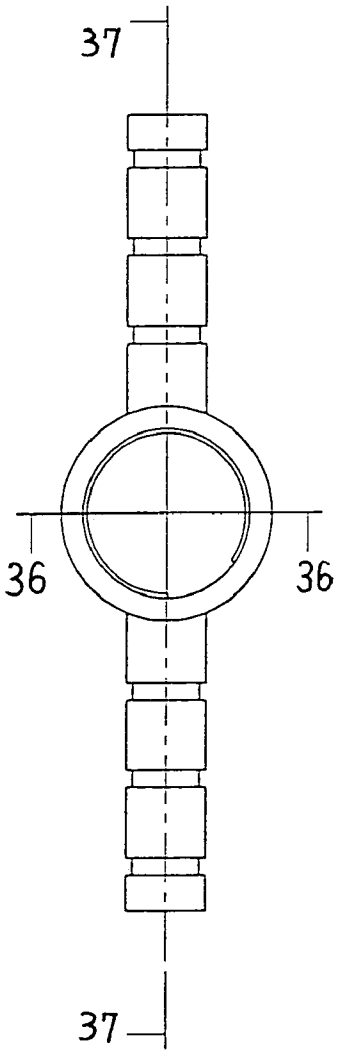
FIG. 35 is a plan assembly view of the socket adapter as shown in FIG. 33.
Figure 37:
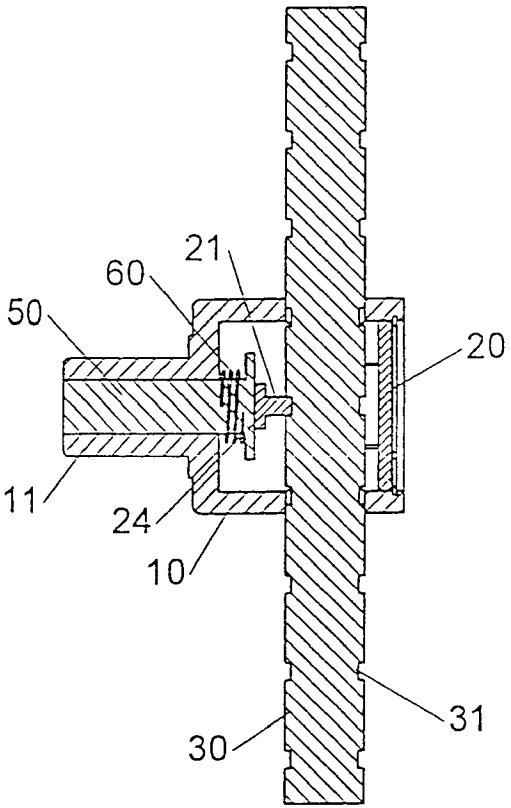
FIG. 37 is a plan cross-sectional view of the socket adapter taken along line 37-37 as shown in FIG. 35.
Figure 39:
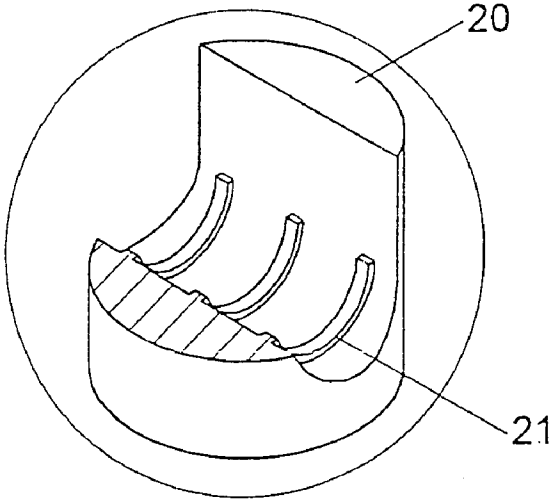
FIG. 39 is a locally enlarged view of the socket adapter as shown in FIG. 38.
Figure 38:
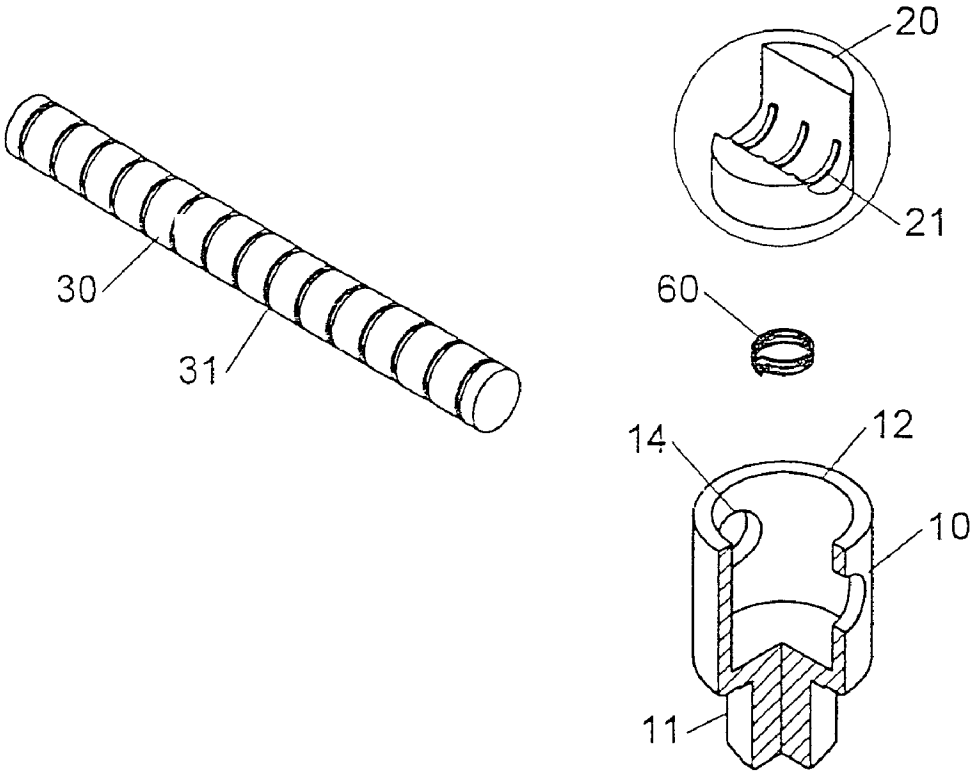
FIG. 38 is a partially exploded perspective cross-sectional view of a socket adapter in accordance with another embodiment of the present invention.
Figure 41:
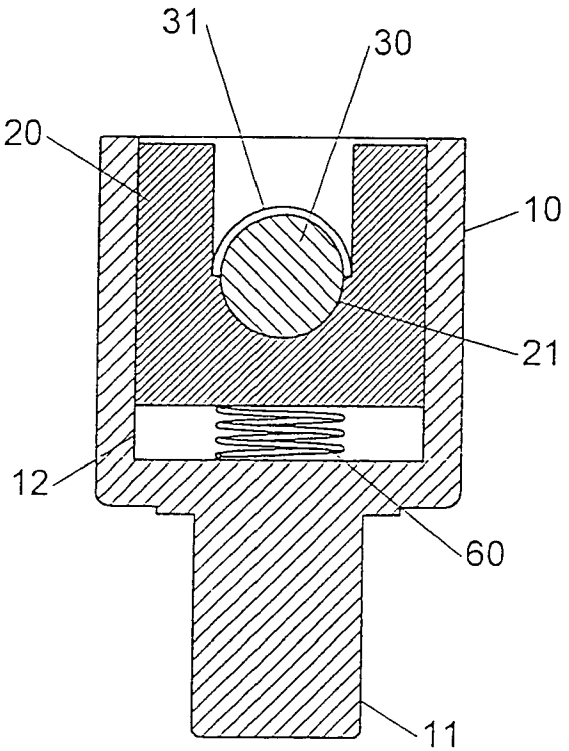
FIG. 41 is a plan cross-sectional view of the socket adapter taken along line 41-41 as shown in FIG. 40.
Figure 40:
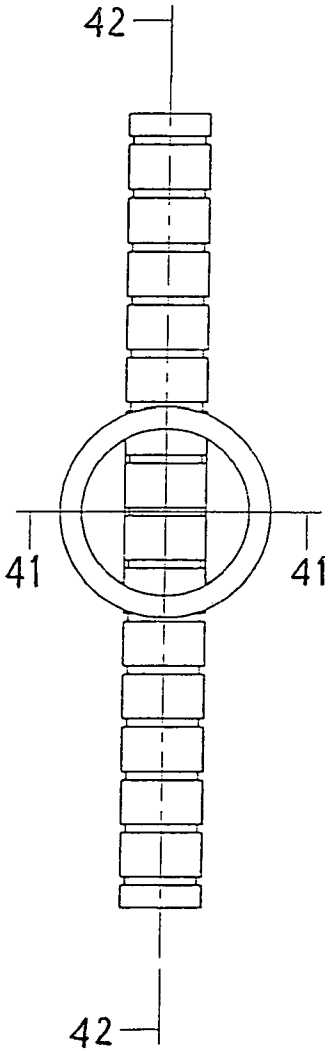
FIG. 40 is a plan assembly view of the socket adapter as shown in FIG. 38.
Figure 42:
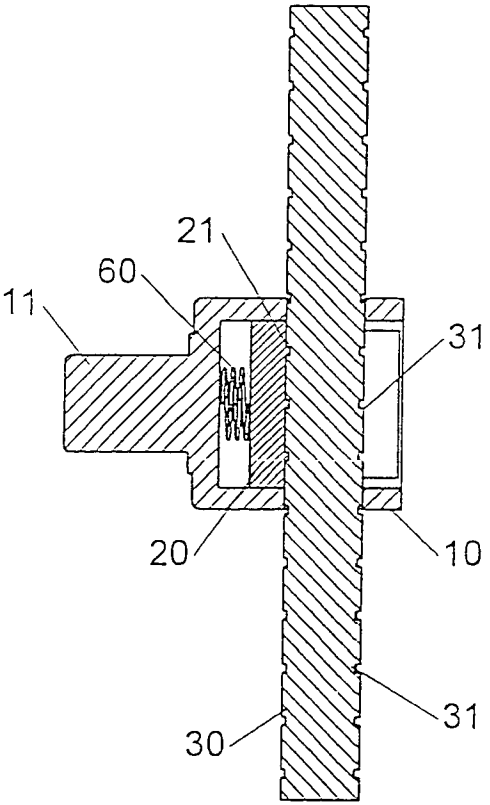
FIG. 42 is a plan cross-sectional view of the socket adapter taken along line 42-42 as shown in FIG. 40.
Figure 43:
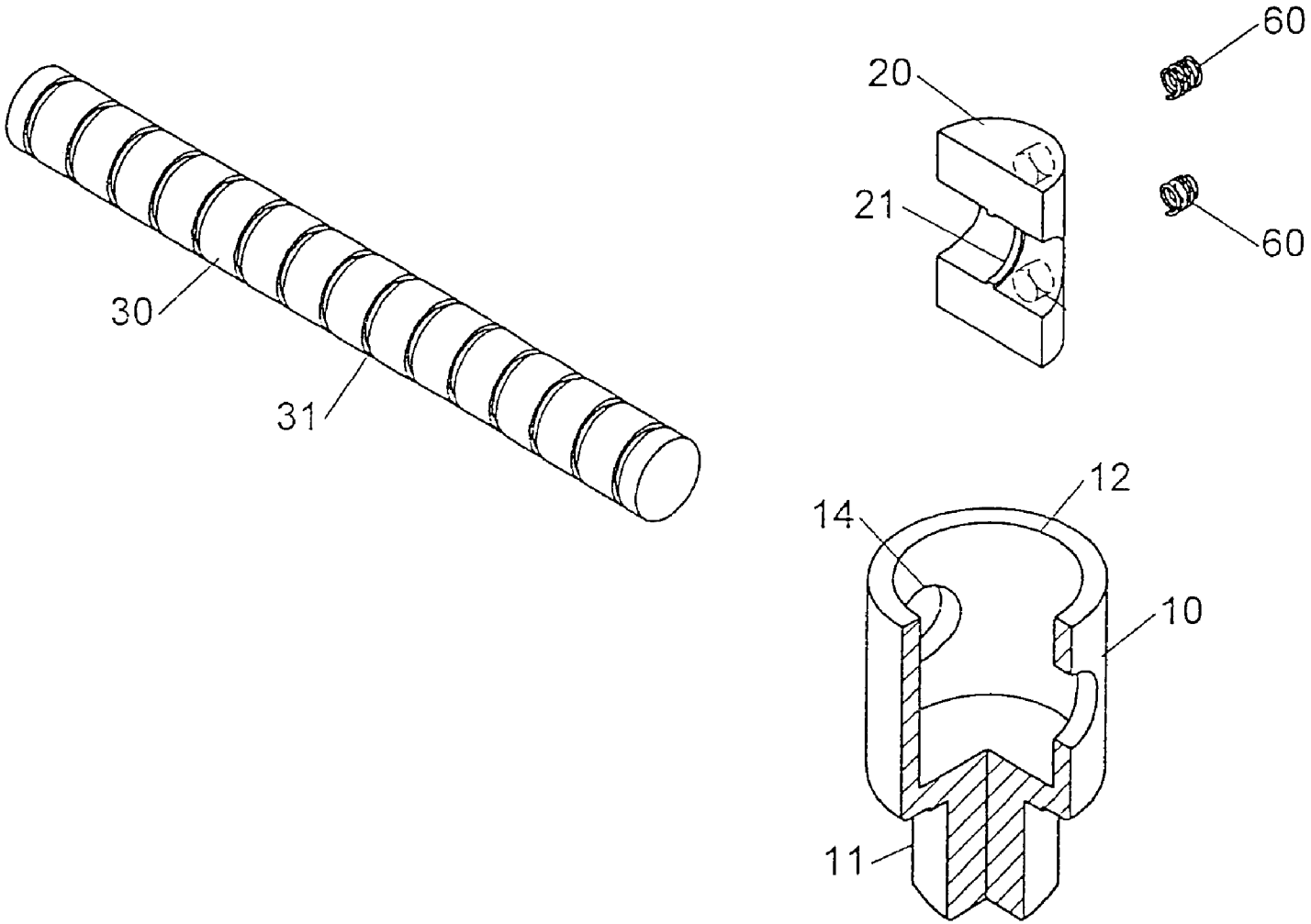
FIG. 43 is a partially exploded perspective cross-sectional view of a socket adapter in accordance with another embodiment of the present invention.
Figure 46:
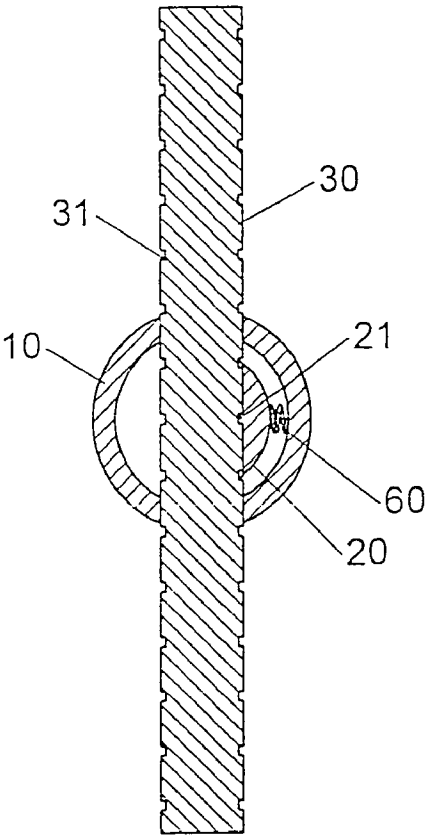
FIG. 46 is a plan cross-sectional view of the socket adapter taken along line 46-46 as shown in FIG. 45.
Figure 45:
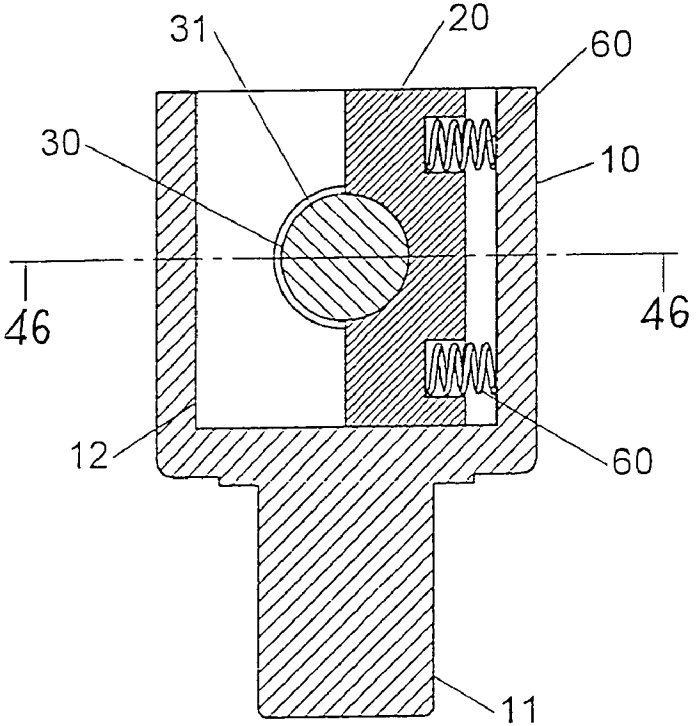
FIG. 45 is a plan cross-sectional view of the socket adapter taken along line 45-45 as shown in FIG. 44.
Figure 44:
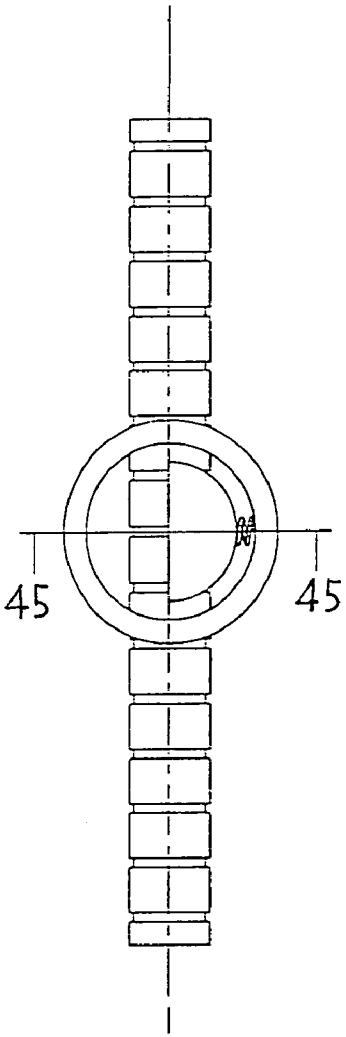
FIG. 44 is a plan assembly view of the socket adapter as shown in FIG. 43.
Figure 47:
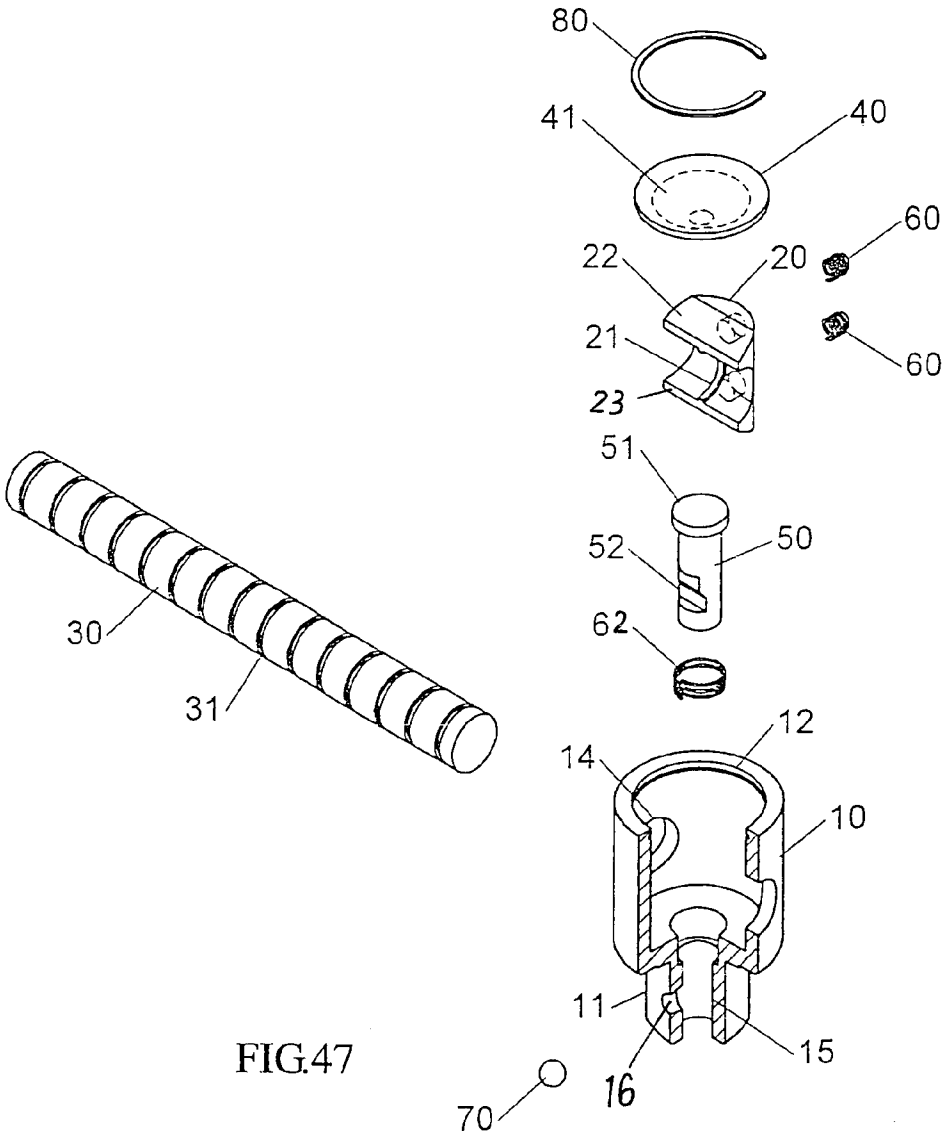
FIG. 47 is a partially exploded perspective cross-sectional view of a socket adapter in accordance with another embodiment of the present invention.
Figure 50:
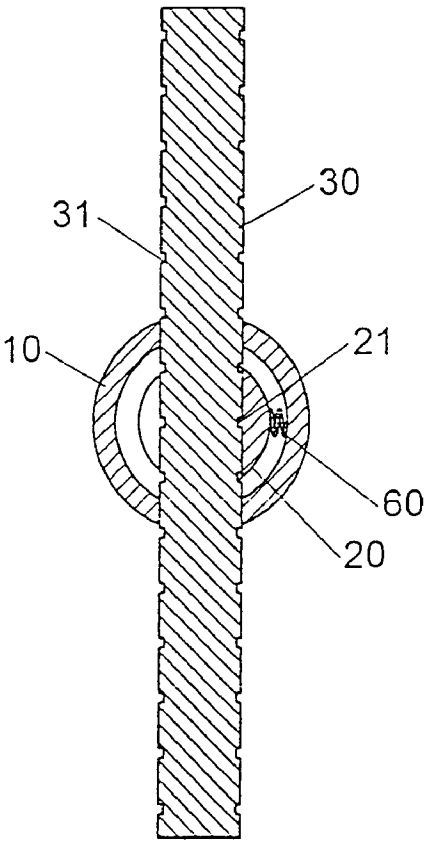
FIG. 50 is a plan cross-sectional view of the socket adapter taken along line 50-50 as shown in FIG. 49.
Figure 49:
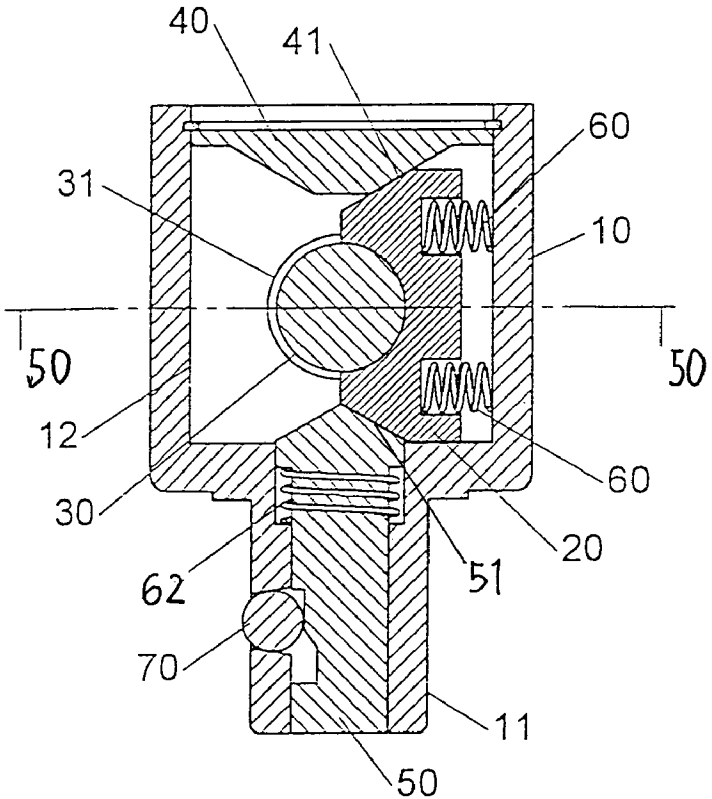
FIG. 49 is a plan cross-sectional view of the socket adapter taken along line 49-49 as shown in FIG. 48.
Figure 48:
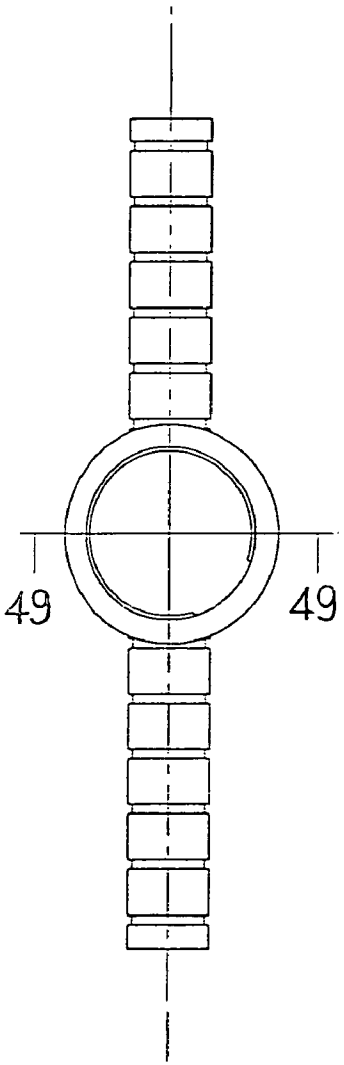
FIG. 48 is a plan assembly view of the socket adapter as shown in FIG. 47.
Figure 52:
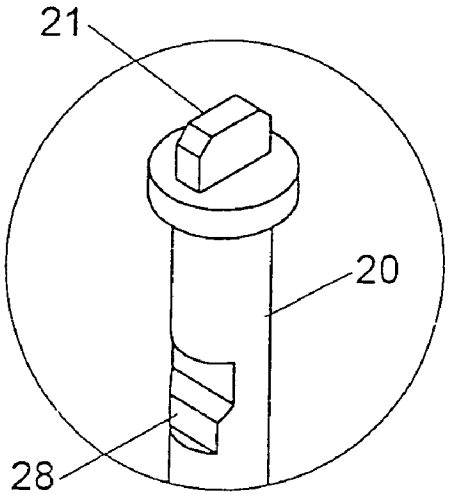
FIG. 52 is a locally enlarged view of the socket adapter as shown in FIG. 51.
Figure 51:
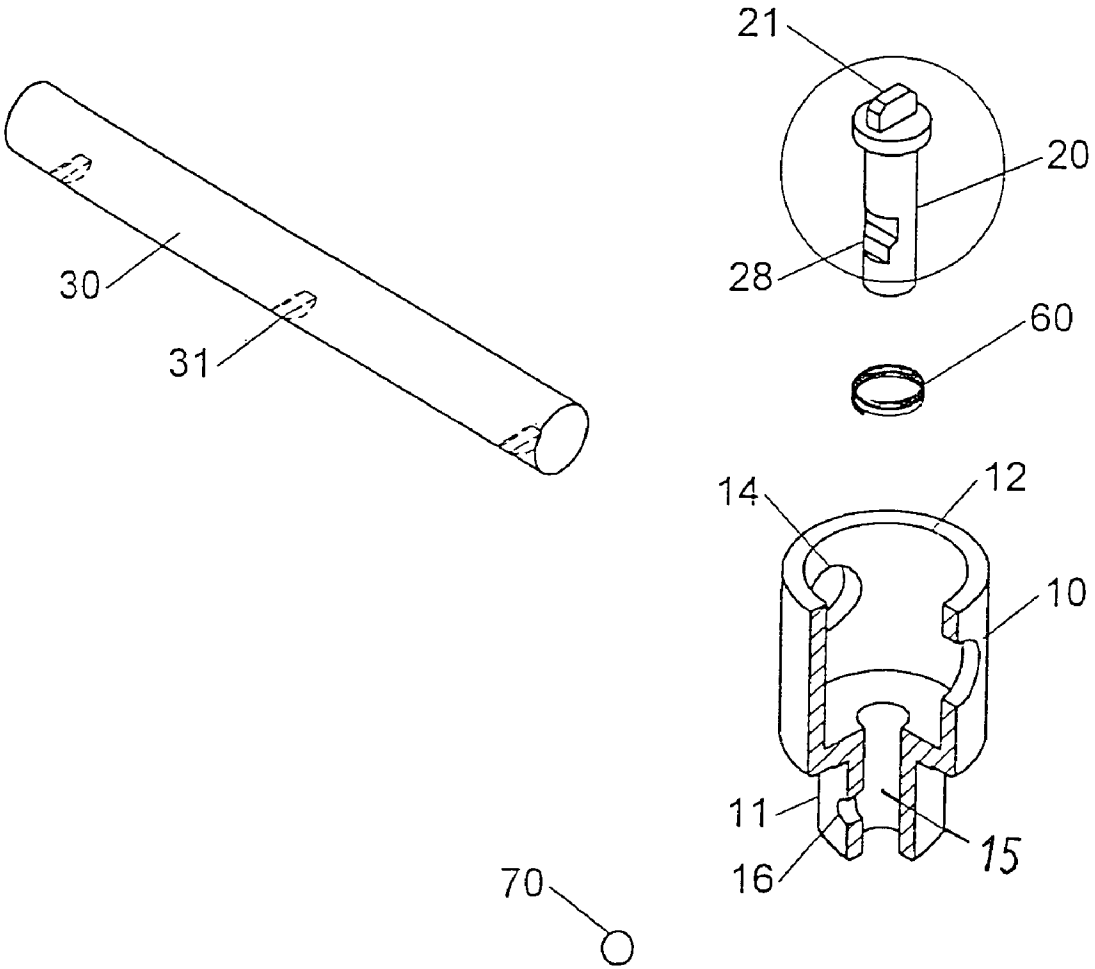
FIG. 51 is a partially exploded perspective cross-sectional view of a socket adapter in accordance with another embodiment of the present invention.
Figure 54:
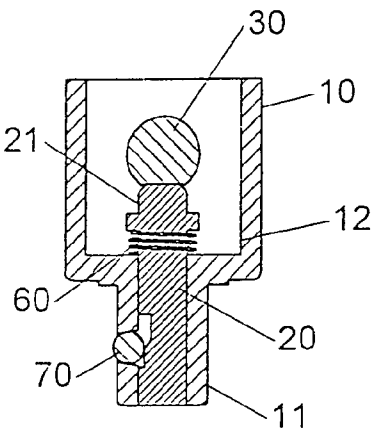
FIG. 54 is a plan cross-sectional view of the socket adapter taken along line 54-54 as shown in FIG. 53.
Figure 53:
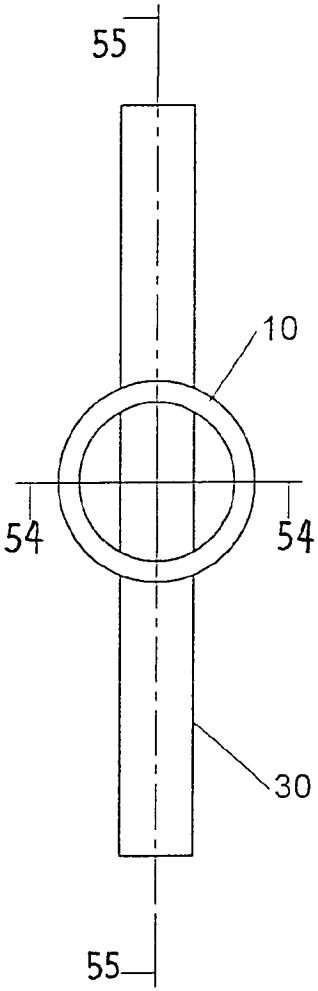
FIG. 53 is a plan assembly view of the socket adapter as shown in FIG. 51.
Figure 55:
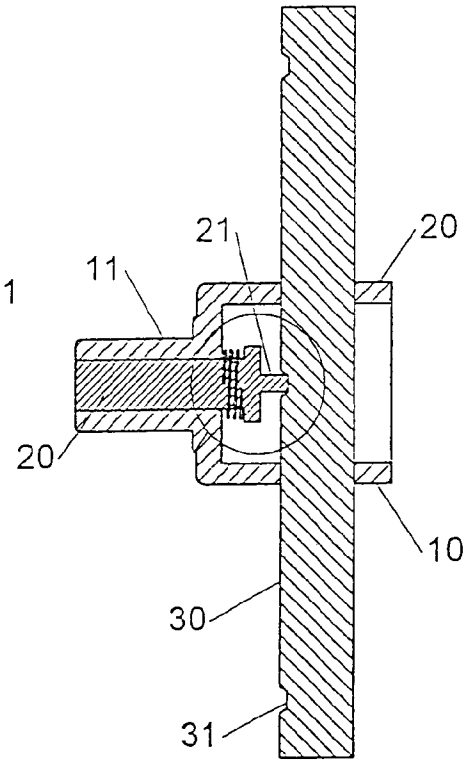
FIG. 55 is a plan cross-sectional view of the socket adapter taken along line 55-55 as shown in FIG. 53.
Figure 56:
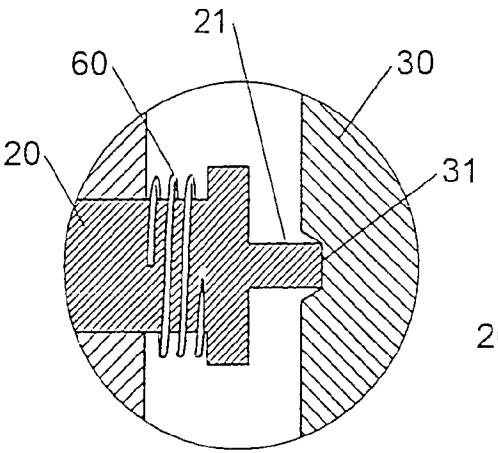
FIG. 56 is a locally enlarged view of the socket adapter as shown in FIG. 55.
Figure 58:
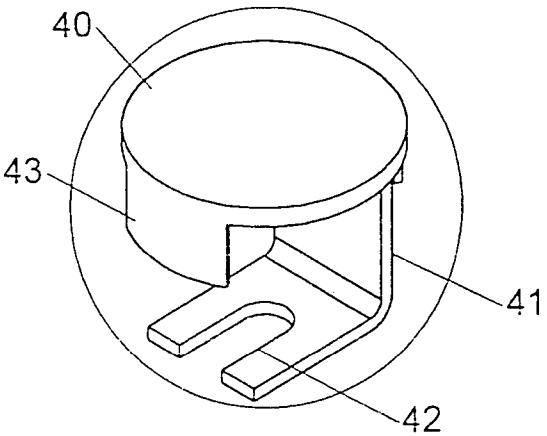
FIG. 58 is a locally enlarged view of the socket adapter as shown in FIG. 57.
Figure 57:
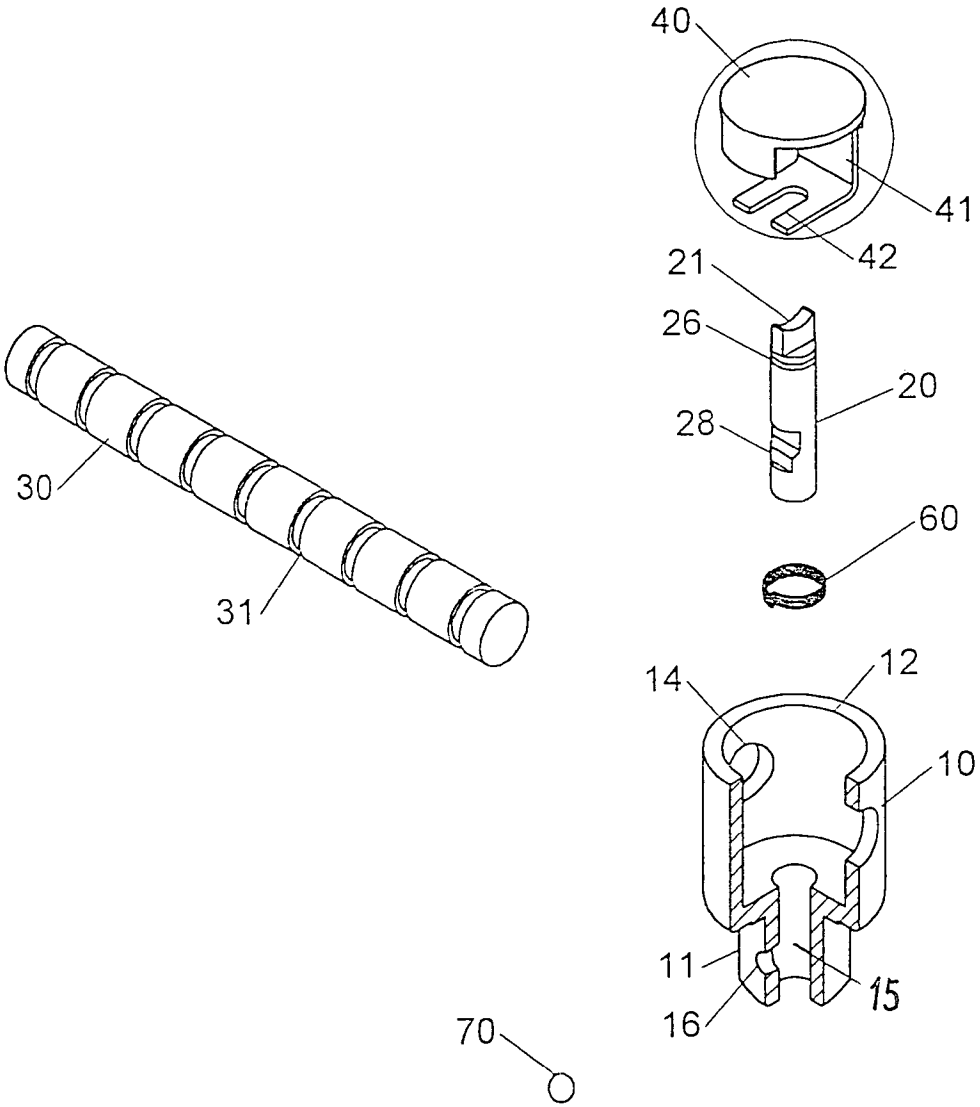
FIG. 57 is a partially exploded perspective cross-sectional view of a socket adapter in accordance with another embodiment of the present invention.
Figure 60:
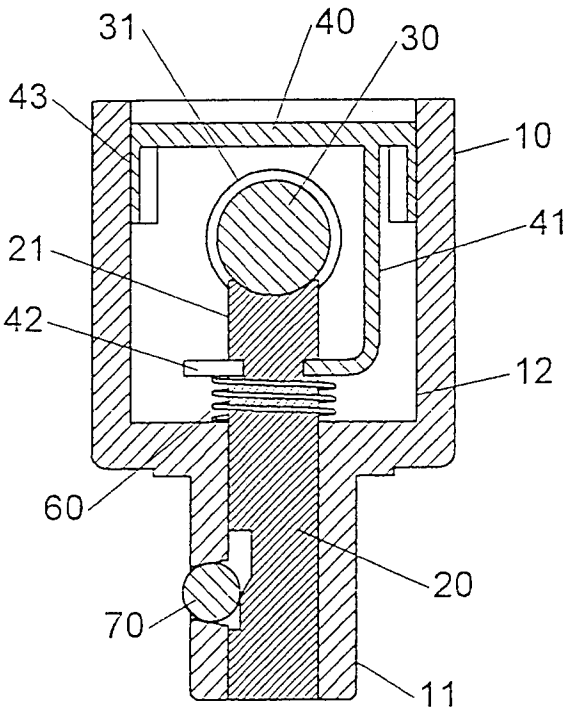
FIG. 60 is a plan cross-sectional view of the socket adapter taken along line 60-60 as shown in FIG. 59.
Figure 59:
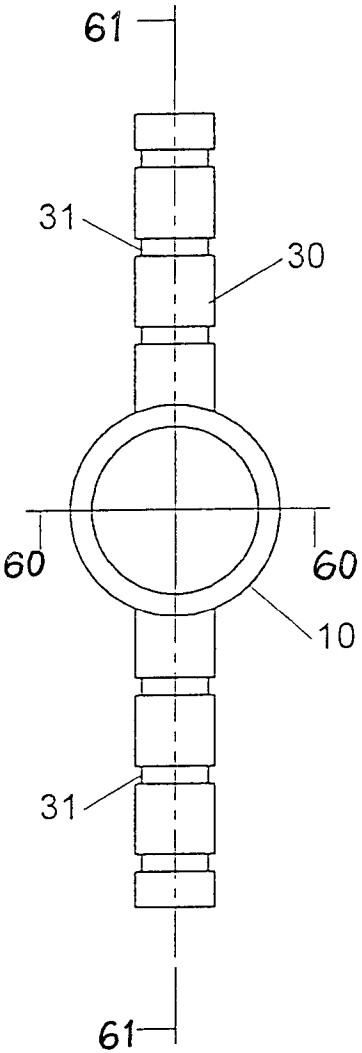
FIG. 59 is a plan assembly view of the socket adapter as shown in FIG. 57.
Figure 61:
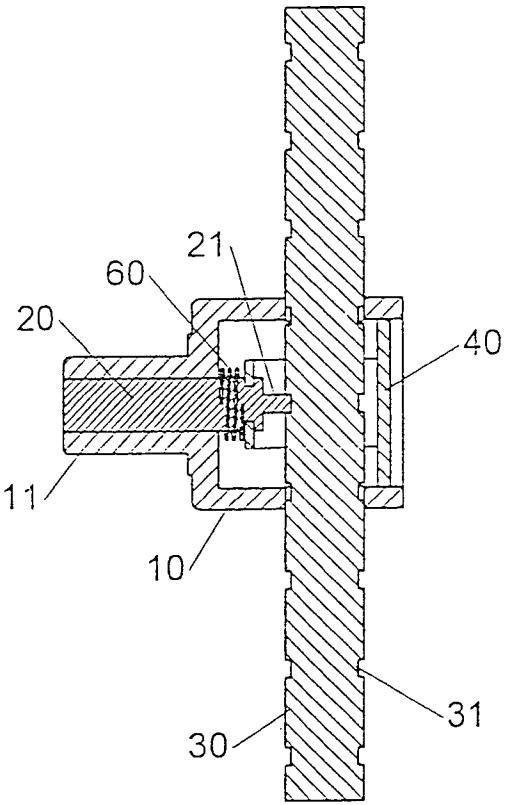
FIG. 61 is a plan cross-sectional view of the socket adapter taken along line 61-61 as shown in FIG. 59.
Figure 63:
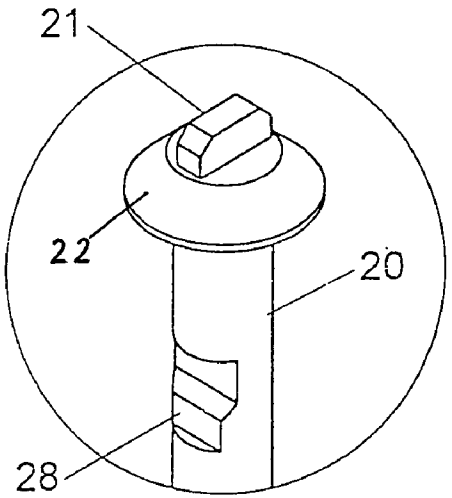
FIG. 63 is a locally enlarged view of the socket adapter as shown in FIG. 62.
Figure 62:
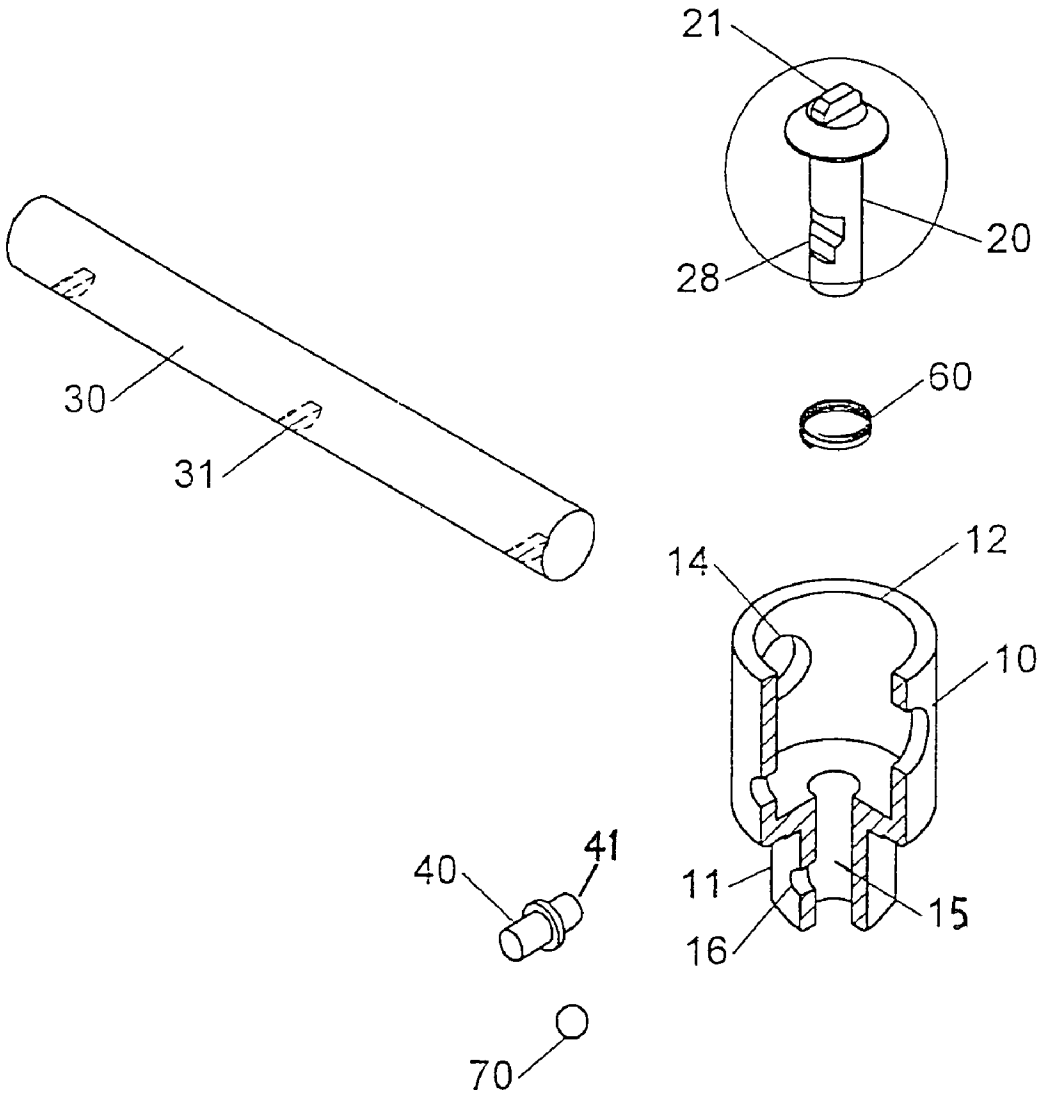
FIG. 62 is a partially exploded perspective cross-sectional view of a socket adapter in accordance with another embodiment of the present invention.
Figure 65:
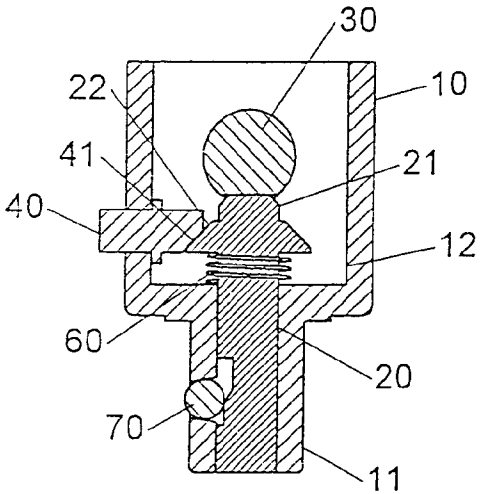
FIG. 65 is a plan cross-sectional view of the socket adapter taken along line 65-65 as shown in FIG. 64.
Figure 64:
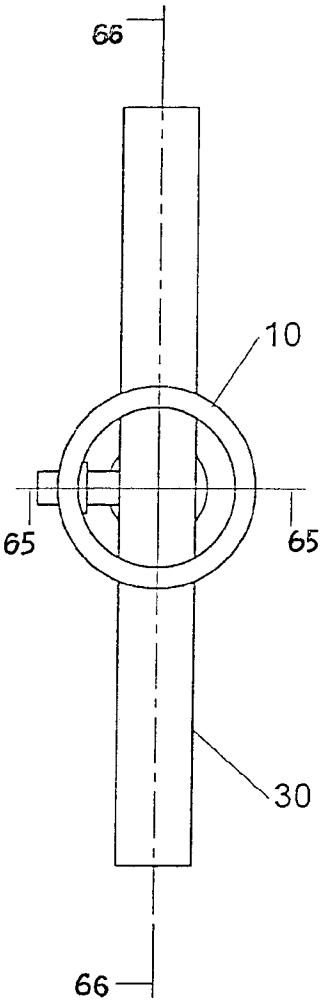
FIG. 64 is a plan assembly view of the socket adapter as shown in FIG. 62.
Figure 66:
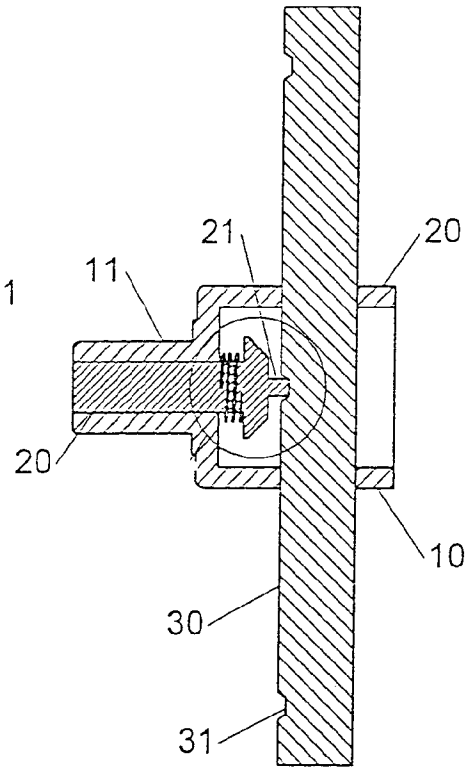
FIG. 66 is a plan cross-sectional view of the socket adapter taken along line 66-66 as shown in FIG. 64.
Figure 67:
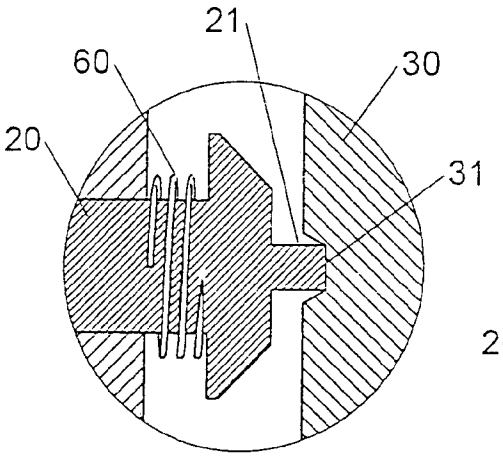
FIG. 67 is a locally enlarged view of the socket adapter as shown in FIG. 66.
Figure 68:
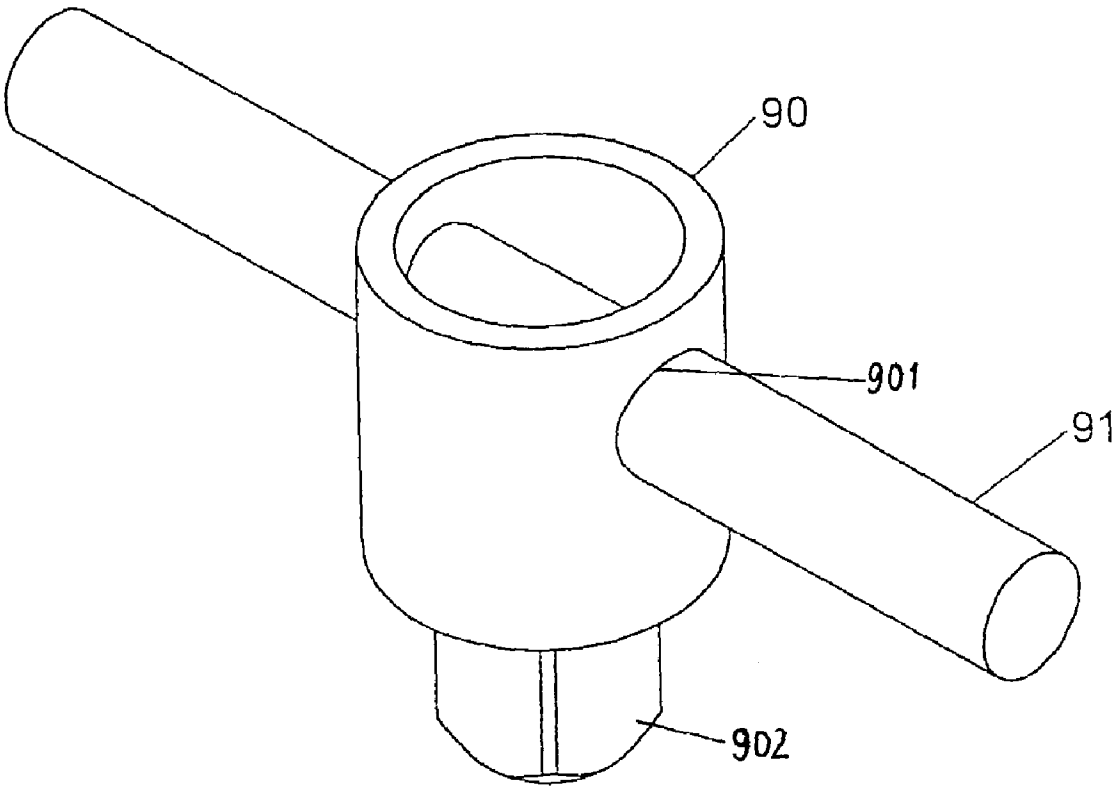
FIG.68 PRIOR ART
FIG. 68 is a perspective view of a conventional socket adapter in accordance with the prior art.
Figure 69:
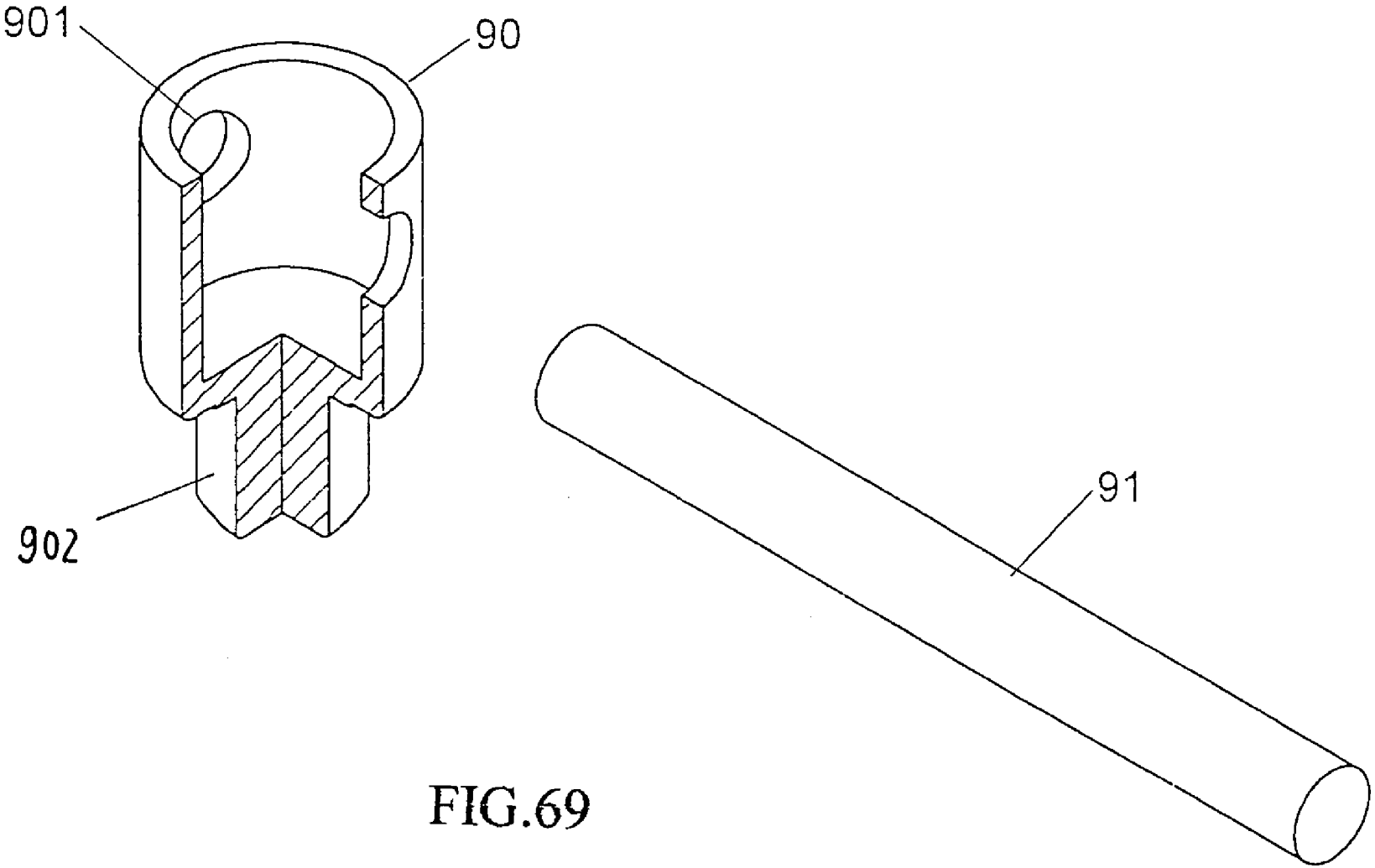
FIG.69 PRIOR ART
FIG. 69 is a partially exploded perspective cross-sectional view of the conventional socket adapter as shown in FIG. 68.

As shown in FIGS. 17 and 18, when the press block 40 is pressed inward, the press portion 41 of the press block 40 is moved and rested on a deeper part of the control portion 22 of the control member 20 to move the control member 20 rightward, so that the locking portion 21 of the control member 20 is locked in one of the locking grooves 31 of the drive rod 30 as shown in FIG. 18, and the drive rod 30 is positioned on the main body 10 by the control member 20. At the same time, the resting portion 23 of the control member 20 is moved rightward to press the protruding block 51 of the operation rod 50 downward so as to move the operation rod 50 downward and to compress the elastic member 60, so that the ball 70 is retracted into and received in a deeper part of the stepped face 52 of the operation rod 50.

Referring to FIGS. 19-22, in accordance with another embodiment of the present invention, the drive head 11 of the main body 10 has an inside formed with an operation slot 15 connected to the receiving recess 12 and a peripheral wall formed with a ball hole 16 connected to the operation slot 15 for receiving a ball 70. The peripheral wall of the main body 10 is formed with a control slot 13 parallel with the slide slot 14. The control member 20 is rotatably mounted in the control slot 13 of the main body 10 and has a first side provided with the locking portion 21 and a second side provided with a protruding resting portion 23. The control member 20 has a distal end provided with a rotation knob 29 protruding outward from the control slot 13 of the main body 10.

The socket adapter further comprises an operation rod 50 movably mounted in the operation slot 15 of the drive head 11 and having a first end formed with a stepped face 52 aligning with the ball hole 16 of the drive head 11 and rested on the ball 70 and a second end rested on the resting portion 23 of the control member 20, and an elastic member 60 mounted on the operation rod 50 and biased between the second end of the operation rod 50 and the receiving recess 12 of the main body 10.

In operation, when the control member 20 is rotated by the rotation knob 29, the locking portion 21 of the control member 20 is locked in one of the locking grooves 31 of the drive rod 30, so that the drive rod 30 is positioned on the main body 10 by the control member 20. At the same time, the resting portion 23 of the control member 20 is moved downward to press the operation rod 50 downward and to compress the elastic member 60, so that the ball 70 is retracted into and received in a deeper part of the stepped face 52 of the operation rod 50.

Referring to FIGS. 23-27, in accordance with another embodiment of the present invention, the locking portion 21 of the control member 20 has a side provided with a mounting stub 211, and the socket adapter further comprises a second elastic member 62 mounted on the mounting stub 211 and biased between the locking portion 21 of the control member 20 and the receiving recess 12 of the main body 10. Thus, the control member 20 is pressed by the elastic force of the second elastic member 62, so that the locking portion 21 of the control member 20 is locked in one of the locking grooves 31 of the drive rod 30, the drive rod 30 is positioned on the main body 10 by the control member 20.

In operation, when the control member 20 is rotated by the rotation knob 29, the second elastic member 62 is compressed, the locking portion 21 of the control member 20 is detached from the locking groove 31 of the drive rod 30, and the resting portion 23 of the control member 20 is moved downward to press the operation rod 50 downward and to compress the elastic member 60, so that the ball 70 is retracted into and received in a deeper part of the stepped face 52 of the operation rod 50.

Referring to FIGS. 28-32, in accordance with another embodiment of the present invention, the control slot 13 of the main body 10 is undefined. The control member 20 is substantially C-shaped and is movably mounted in the receiving recess 12 of the main body 10 to encompass the drive rod 30. The control member 20 has an extension 24 having a first side provided with the locking portion 21 and has a periphery provided with a slide 25 slidably mounted in the receiving recess 12 of the main body 10.

The socket adapter further comprises a snap ring 80 secured in the receiving recess 12 of the main body 10 and rested on a top of the control member 20 to retain the control member 20 in the receiving recess 12 of the main body 10, and an elastic member 60 biased between a second side of the extension 24 of the control member 20 and the receiving recess 12 of the main body 10 to push the locking portion 21 of the control member 20 toward the drive rod 30, so that the locking portion 21 of the control member 20 is locked in one of the locking grooves 31 of the drive rod 30, and the drive rod 30 is positioned on the main body 10 by the control member 20.

In operation, when the control member 20 is pressed downward, the elastic member 60 is compressed, and the locking portion 21 of the control member 20 is detached from the locking groove 31 of the drive rod 30.

Referring to FIGS. 33-37, in accordance with another embodiment of the present invention, the drive head 11 of the main body 10 has an inside formed with an operation slot 15 connected to the receiving recess 12 and a peripheral wall formed with a ball hole 16 connected to the operation slot 15 for receiving a ball 70.

The socket adapter further comprises an operation rod 50 movably mounted in the operation slot 15 of the drive head 11 and having a first end formed with a stepped face 52 aligning with the ball hole 16 of the drive head 11 and rested on the ball 70 and a second end rested on a second side of the extension 24 of the control member 20, and an elastic member 60 mounted on the operation rod 50 and biased between the second end of the operation rod 50 and the receiving recess 12 of the main body 10 to push the locking portion 21 of the control member 20 toward the drive rod 30, so that the locking portion 21 of the control member 20 is locked in one of the locking grooves 31 of the drive rod 30, and the drive rod 30 is positioned on the main body 10 by the control member 20.

In operation, when the control member 20 is pressed downward, the operation rod 50 is moved downward to compress the elastic member 60, so that the ball 70 is retracted into and received in a deeper part of the stepped face 52 of the operation rod 50.

Referring to FIGS. 38-42, in accordance with another embodiment of the present invention, the control slot 13 of the main body 10 is undefined. The control member 20 is substantially U-shaped and is movably mounted in the receiving recess 12 of the main body 10 to encompass the drive rod 30. The control member 20 has a first side provided with the locking portion 21.

The socket adapter further comprises an elastic member 60 biased between a second side of the control member 20 and the receiving recess 12 of the main body 10 to push the locking portion 21 of the control member 20 toward the drive rod 30, so that the locking portion 21 of the control member 20 is locked in one of the locking grooves 31 of the drive rod 30, and the drive rod 30 is positioned on the main body 10 by the control member 20.

In operation, when the control member 20 is pressed downward, the elastic member 60 is compressed, and the locking portions 21 of the control member 20 are detached from the locking grooves 31 of the drive rod 30.

Referring to FIGS. 43-46, in accordance with another embodiment of the present invention, the control slot 13 of the main body 10 is undefined. The control member 20 is substantially C-shaped and is movably mounted in the receiving recess 12 of the main body 10 to encompass the drive rod 30. The control member 20 has a first side provided with the locking portion 21.

The socket adapter further comprises two elastic members 60 biased between a second side of the control member 20 and the receiving recess 12 of the main body 10 to push the locking portion 21 of the control member 20 toward the drive rod 30, so that the locking portion 21 of the control member 20 is locked in one of the locking grooves 31 of the drive rod 30, and the drive rod 30 is positioned on the main body 10 by the control member 20.

In operation, when the control member 20 is pressed rightward, the elastic members 60 are compressed, and the locking portion 21 of the control member 20 is detached from the locking groove 31 of the drive rod 30.

Referring to FIGS. 47-50, in accordance with another embodiment of the present invention, the drive head 11 of the main body 10 has an inside formed with an operation slot 15 connected to the receiving recess 12 and a peripheral wall formed with a ball hole 16 connected to the operation slot 15 for receiving a ball 70. The control member 20 has an upper end formed with an inclined control portion 22 and a lower end formed with an inclined resting portion 23.

The socket adapter further comprises an operation rod 50 movably mounted in the operation slot 15 of the drive head 11 and having a first end formed with a stepped face 52 aligning with the ball hole 16 of the drive head 11 and rested on the ball 70 and a second end formed with a protruding oblique block 51 rested on the resting portion 23 of the control member 20, a second elastic member 62 mounted on the operation rod 50 and biased between the second end of the operation rod 50 and the receiving recess 12 of the main body 10, a press block 40 movably mounted in the receiving recess 12 of the main body 10 and provided with a protruding oblique press portion 41 rested on the control portion 22 of the control member 20, and a snap ring 80 secured in the receiving recess 12 of the main body 10 and rested on the press block 40 to retain the press block 40 in the receiving recess 12 of the main body 10.

In operation, when the press block 40 is pressed downward, the press portion 41 of the press block 40 is moved and rested on the control portion 22 of the control member 20 to move the control member 20 rightward, so that the locking portion 21 of the control member 20 is detached from the respective locking groove 31 of the drive rod 30. At the same time, the resting portion 23 of the control member 20 is moved rightward to release the protruding block 51 of the operation rod 50, so that the operation rod 50 is pushed upward by the restoring force of the elastic member 62 and the ball 70 is retracted into and received in a deeper part of the stepped face 52 of the operation rod 50.

Referring to FIGS. 51-56, in accordance with another embodiment of the present invention, the drive head 11 of the main body 10 has an inside formed with an operation slot 15 connected to the receiving recess 12 and a peripheral wall formed with a ball hole 16 connected to the operation slot 15 for receiving a ball 70. The control member 20 is movably mounted in the operation slot 15 of the drive head 11 and has an upper end provided with the locking portion 21 and a lower end formed with a stepped face 28 aligning with the ball hole 16 of the drive head 11 and rested on the ball 70.

The socket adapter further comprises an elastic member 60 mounted on the control member 20 and biased between the upper end of the control member 20 and the receiving recess 12 of the main body 10 to push the locking portion 21 of the control member 20 toward the drive rod 30, so that the locking portion 21 of the control member 20 is locked in one of the locking grooves 31 of the drive rod 30, and the drive rod 30 is positioned on the main body 10 by the control member 20.

In operation, when the control member 20 is pressed downward, the locking portion 21 of the control member 20 is detached from the respective locking groove 31 of the drive rod 30, and the ball 70 is retracted into and received in a deeper part of the stepped face 28 of the control member 20.

Referring to FIGS. 57-61, in accordance with another embodiment of the present invention, the socket adapter further comprises a press block 40 movably mounted in the receiving recess 12 of the main body 10 and provided with a protruding press portion 41 having a fixing portion 42 secured on a fixing portion 26 of the upper end of the control member 20, and an elastic member 60 mounted on the control member 20 and biased between the fixing portion 42 of the press portion 41 of the press block 40 and the receiving recess 12 of the main body 10 to push the locking portion 21 of the control member 20 toward the drive rod 30, so that the locking portion 21 of the control member 20 is locked in one of the locking grooves 31 of the drive rod 30, and the drive rod 30 is positioned on the main body 10 by the control member 20. The press block 40 has a periphery provided with a slide 43 slidably mounted in the receiving recess 12 of the main body 10.

In operation, when the press block 40 is pressed downward, the control member 20 is pressed to move downward, so that the locking portion 21 of the control member 20 is detached from the respective locking groove 31 of the drive rod 30, and the ball 70 is retracted into and received in a deeper part of the stepped face 28 of the control member 20.

Referring to FIGS. 62-67, in accordance with another embodiment of the present invention, the peripheral wall of the main body 10 is formed with a control slot 13 located perpendicular to the slide slot 14, and the upper end of the control member 20 is formed with an inclined control portion 22.

The socket adapter further comprises a press block 40 movably mounted in the control slot 13 of the main body 10 and having a distal end provided with an inclined press portion 41 rested on the inclined control portion 22 of the control member 20.

In operation, when the press block 40 is pressed inward, the control member 20 is pressed to move downward, so that the locking portion 21 of the control member 20 is detached from the respective locking groove 31 of the drive rod 30, and the ball 70 is retracted into and received in a deeper part of the stepped face 28 of the control member 20.

Accordingly, the drive rod 30 has a plurality of locking grooves 31, and the control member 20 has a locking portion 21, so that when the control member 20 is moved relative to the drive rod 30, the locking portion 21 of the control member 20 is locked in or detached from the respective locking groove 31 of the drive rod 30, thereby positioning the drive rod 30 on the main body 10 or releasing the drive rod 30 from the main body 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A socket adapter, comprising:

a body having an inside formed with a receiving recess, a peripheral wall formed with a slide slot connected to the receiving recess;

a drive head extending from the body and comprising an inside formed with an operation slot in communication with the receiving recess and a periphery formed with a ball hole in communication with the operation slot for receiving a ball;

a drive rod slidably inserted in the slide slot of the body and formed with a plurality of locking grooves;

a control member movably inserted in the body and provided with a locking portion detachably locked in one of the locking grooves of the drive rod;

an operation rod movably being inserted in the operation slot of the drive head and comprising a first end formed with a stepped face in alignment with the ball hole of the drive head and rested on the ball and a second end rested on the control member; and an elastic member compressed between the second end of the operation rod and the body to push the locking portion of the control member towards the drive rod so that the locking portion of the control member is locked in one of the locking grooves of the drive rod.

* * * * *